US012102183B2

(12) United States Patent
Champagne et al.

(10) Patent No.: US 12,102,183 B2
(45) Date of Patent: Oct. 1, 2024

(54) SKATE BOOT WITH TENDON GUARD

(71) Applicant: Sport Maska Inc., Montréal (CA)

(72) Inventors: Etienne Champagne, Montréal (CA); Alain Kieu, St-Jerome (CA); Alexis Faucher, St-Rose (CA); Samuel Maheux, Montréal (CA)

(73) Assignee: Sport Maska Inc., Montréal (CA)

( * ) Notice: Subject to any disclaimer, the term of this patent is extended or adjusted under 35 U.S.C. 154(b) by 361 days.

(21) Appl. No.: 17/377,935

(22) Filed: Jul. 16, 2021

(65) Prior Publication Data

US 2021/0337918 A1 Nov. 4, 2021

Related U.S. Application Data

(63) Continuation of application No. PCT/CA2020/050050, filed on Jan. 17, 2020.

(60) Provisional application No. 62/794,241, filed on Jan. 18, 2019.

(51) Int. Cl.
*A43B 5/16* (2006.01)

(52) U.S. Cl.
CPC ..... *A43B 5/1691* (2013.01); *A43B 5/1625* (2013.01)

(58) Field of Classification Search
CPC ... A43B 5/0429; A43B 5/0439; A43B 5/0452; A43B 5/0454; A43B 5/0456; A43B 5/0482; A43B 5/1625; A43B 5/1691
See application file for complete search history.

(56) References Cited

U.S. PATENT DOCUMENTS

| | | | | |
|---|---|---|---|---|
| 6,550,159 | B1 * | 4/2003 | Madore | A43B 5/1691 280/11.18 |
| 7,398,609 | B2 * | 7/2008 | Labonte | A43B 5/1691 36/88 |
| 7,451,991 | B2 | 11/2008 | Labont | |
| 7,533,479 | B2 | 5/2009 | Labont | |
| 8,505,217 | B2 | 8/2013 | Stewart | |
| 8,596,650 | B2 | 12/2013 | Van Horne et al. | |
| 8,684,368 | B2 * | 4/2014 | Van Horne | A43B 23/26 280/11.12 |

(Continued)

FOREIGN PATENT DOCUMENTS

| | | |
|---|---|---|
| CA | 2506005 C | 8/2009 |
| CA | 2497026 C | 9/2009 |

(Continued)

OTHER PUBLICATIONS

Document relating to International Application No. PCT/CA2020/050050 (WO2020/146951), "International Search Report and the Written Opinion", mailed May 1, 2020, Canadian Intellectual Property Office, 8 pages.

*Primary Examiner* — Sharon M Prange

(57) ABSTRACT

A tendon guard for a skate boot includes (a) a structural guard frame configured to protect an Achilles tendon of a wearer of the skate boot; and (b) a mount configured to join the guard frame to a shell of the skate boot. The mount includes a mount flex portion having sufficient flexibility to permit rearward movement of an upper portion of the frame in response to application of a rearward force on the upper portion by a lower leg of the wearer during plantarflexion. The mount flex portion has sufficient resiliency to urge the upper portion back toward a resting position when the rearward force is relieved.

17 Claims, 23 Drawing Sheets

(56) References Cited

U.S. PATENT DOCUMENTS

| | | | | |
|---|---|---|---|---|
| 9,004,502 | B2 | 4/2015 | Van Horne et al. | |
| 9,320,315 | B2 * | 4/2016 | Van Horne | A43B 5/16 |
| 9,408,435 | B2 | 8/2016 | Labonte | |
| 9,510,639 | B2 | 12/2016 | Cruikshank et al. | |
| 9,717,300 | B2 | 8/2017 | Van Horne et al. | |
| 9,878,229 | B2 | 1/2018 | Lefebvre et al. | |
| 10,105,585 | B2 | 10/2018 | Labonte | |
| 2005/0229436 | A1 * | 10/2005 | Bock | A43B 5/1625 36/89 |
| 2009/0243238 | A1 | 10/2009 | Van Horne et al. | |
| 2011/0101665 | A1 * | 5/2011 | Van Horne | A43B 23/26 280/841 |
| 2013/0247425 | A1 * | 9/2013 | Davis | A43B 13/026 36/30 R |
| 2014/0252736 | A1 * | 9/2014 | Lefebvre | A43B 5/0496 280/11.12 |
| 2014/0259780 | A1 * | 9/2014 | Labonte | A43B 5/0405 36/102 |
| 2016/0325172 | A1 | 11/2016 | Labonte | |
| 2016/0332063 | A1 * | 11/2016 | Van Horne | A43B 23/0215 |
| 2017/0311677 | A1 | 11/2017 | Van Horne et al. | |
| 2018/0043233 | A1 * | 2/2018 | Harvey | A63C 3/00 |

FOREIGN PATENT DOCUMENTS

| | | | |
|---|---|---|---|
| CA | 2496987 | C | 11/2010 |
| CA | 2801233 | C | 6/2014 |
| CA | 2891170 | C | 2/2018 |
| CA | 2809462 | C | 2/2019 |
| EP | 1716771 | B1 | 7/2008 |
| WO | 2020146951 | A1 | 7/2020 |

* cited by examiner

SKATE BOOT WITH TENDON GUARD

CROSS-REFERENCE TO RELATED APPLICATIONS

This application is a continuation of International Application No. PCT/CA2020/050050, filed Jan. 17, 2020 and entitled SKATE BOOT WITH TENDON GUARD, which claims the benefit of U.S. Provisional Application No. 62/794,241, filed Jan. 18, 2019 and entitled SKATE BOOT WITH TENDON GUARD, each of which is hereby incorporated herein by reference in its entirety.

FIELD

This disclosure relates generally to skates, and more specifically, to skate boots with tendon guards.

BACKGROUND

Skates, such as, for example, ice and/or roller skates, often include a tendon guard for protecting an Achilles tendon of a wearer. In some cases, the tendon guard is constructed to flex rearwardly for accommodating rearward movement of a lower leg of the wearer during plantarflexion.

SUMMARY

The following summary is intended to introduce the reader to various aspects of the applicant's teaching, but not to define any invention.

According to some aspects, a skate boot includes: (a) a structural shell configured to cover at least a rear and sides of a foot of a wearer; and (b) a tendon guard attached to the shell and configured to protect an Achilles tendon of the wearer. The tendon guard includes: (i) a structural guard frame having a lower portion and an upper portion extending above a rear upper edge of the shell, the upper portion configured to protect at least a portion of the Achilles tendon above the shell; and (ii) a mount joining the guard frame to the shell. The mount has a mount front portion attached to the shell, a mount rear portion spaced rearwardly from the mount front portion and attached to the lower portion of the guard frame, and a mount flex portion intermediate and joining the front and rear portions. The mount flex portion has sufficient flexibility to permit rearward movement of the upper portion of the frame from a resting position toward a rearward position in response to application of a rearward force on the upper portion by a lower leg of the wearer during plantarflexion. The mount flex portion has sufficient resiliency to urge the upper portion back toward the resting position when the rearward force is relieved.

In some examples, the guard frame has a stiffness inhibiting flexion of the guard frame during movement of the upper portion between the resting and rearward positions.

In some examples, the mount flex portion is disposed below the rear upper edge of the shell.

In some examples, the guard frame extends along a longitudinal axis between an upper end and a lower end, and the mount flex portion is vertically intermediate the upper portion and the lower end of the guard frame.

In some examples, the mount rear portion comprises a rearwardly directed face and the lower portion of the frame is mounted against the rearwardly directed face.

In some examples, the mount rear portion comprises a mounting slot and the lower portion of the guard frame is received in the slot.

In some examples, the mount flex portion has an arcuate geometry curving around a shell rear portion of the shell between lateral and medial portions of the shell.

In some examples, the mount front portion comprises a front panel, the mount rear portion comprises at least one rear panel, and the mount flex portion comprises at least one beam member extending substantially horizontally between the front and rear panels.

In some examples, the front panel is oriented generally vertically and the mount flex portion is oriented generally horizontally.

In some examples, each of the front panel and the rear panel has a respective upper edge and a respective lower edge vertically opposite the upper edge, and the mount flex portion is vertically intermediate the upper and lower edges of the front and rear panels.

In some examples, each of the front panel, the rear panel, and the mount flex portion has an arcuate geometry curving around a shell rear portion of the shell between lateral and medial portions of the shell.

In some examples, the guard frame is of integral, unitary, one-piece construction.

In some examples, the mount is of integral unitary, one-piece construction.

In some examples, the mount comprises a core forming the mount flex portion and one or more outer layers molded over the core. In some examples, the outer layers form at least one of a front of the mount front portion and a rear of the mount rear portion. In some examples, the core is formed of a core material and the outer layers are formed of an outer layer material. The core material is more flexible than the outer layer material.

According to some aspects, a tendon guard for a skate boot having a shell includes: (a) a structural guard frame configured to protect an Achilles tendon of a wearer of the skate boot; and (b) a mount configured to join the guard frame to the shell of the skate boot. The mount includes a mount flex portion having sufficient flexibility to permit rearward movement of an upper portion of the frame in response to application of a rearward force on the upper portion by a lower leg of the wearer during plantarflexion, and the mount flex portion has sufficient resiliency to urge the upper portion back toward a resting position when the rearward force is relieved.

According to some aspects, a method of using a skate boot includes: (a) providing a structural shell of the skate boot, the shell configured to cover at least a rear and sides of a foot of a wearer; (b) providing a tendon guard attached to the shell and configured to protect an Achilles tendon of the wearer, the tendon guard including a structural guard frame and a mount joining the guard frame to the shell; (c) applying a rearward force on an upper portion of the guard frame to flex the tendon guard rearwardly about a resilient flex portion of the mount and move the upper portion from a resting position toward a rearward position; and (d) relieving the rearward force to permit the flex portion to move the upper portion back to the resting position.

According to some aspects, a skate boot includes: (a) a structural shell configured to cover at least a rear and sides of a foot of a wearer; and (b) a tendon guard attached to the shell and configured to protect an Achilles tendon of the wearer. The tendon guard includes: (i) a lower portion attached to the shell, (ii) an upper portion extending above a rear upper edge of the shell, the upper portion configured to protect at least a portion the Achilles tendon above the shell, and (iii) a flex portion located below the rear upper edge of the shell. The flex portion has sufficient flexibility to permit rearward movement of the upper portion from a resting position toward a rearward position in response to application of a rearward force on the upper portion by a lower leg of the wearer during plantarflexion, and the flex portion has sufficient resiliency to urge the upper portion back toward the resting position when the rearward force is relieved.

In some examples, the tendon guard includes a structural guard frame comprising the upper, lower, and flex portions.

In some examples, the tendon guard includes a structural guard frame comprising the upper and lower portions, and a mount joining the guard frame to the shell and comprising the flex portion.

In some examples, a skate boot includes: (a) a structural shell configured to cover at least a rear and sides of a foot of a wearer; and (b) a tendon guard attached to the shell and configured to protect an Achilles tendon of the wearer. The tendon guard includes a flex portion located below a rear upper edge of the shell. The flex portion has sufficient flexibility to permit rearward movement of an upper portion of the tendon guard in response to application of a rearward force on the upper portion by a lower leg of the wearer during plantarflexion, and the flex portion has sufficient resiliency to urge the upper portion back toward a resting position when the rearward force is relieved.

According to some aspects, a method of using a skate boot includes: (a) providing a structural shell of the skate boot, the shell configured to cover at least a rear and sides of a foot of a wearer; (b) providing a tendon guard attached to the shell and configured to protect an Achilles tendon of the wearer; (c) applying a rearward force on an upper portion of the tendon guard to flex the tendon guard rearwardly about a resilient flex portion of the tendon guard and move the upper portion from a resting position to a rearward position, the flex portion disposed below a rear upper edge of the shell; and (d) relieving the rearward force to permit the flex portion to move the upper portion back to the resting position.

According to some aspects, a skate boot includes: (a) a structural shell configured to cover at least a rear and sides of a foot of a wearer, the shell made of a first material; and (b) a tendon guard attached to the shell and configured to protect an Achilles tendon of the wearer, the tendon guard including a structural guard frame made of a second material stiffer than the first material. The frame includes: (i) a lower portion attached to the shell, (ii) an upper portion extending above a rear upper edge of the shell, the upper portion configured to protect at least a portion the Achilles tendon above the shell, and (iii) a flex portion vertically intermediate the upper and lower portions. The flex portion has sufficient flexibility to permit rearward movement of the upper portion from a resting position toward a rearward position in response to application of a rearward force on the upper portion by a lower leg of the wearer during plantarflexion, and the flex portion has sufficient resiliency to urge the upper portion back toward the resting position when the rearward force is relieved.

In some examples, the upper portion has a first geometry and the flex portion has a second geometry, the second geometry having a reduced flexural rigidity relative to the first geometry.

In some examples, the first geometry is configured to inhibit flexure of the upper portion during application of the rearward force, and the reduced flexural rigidity of the second geometry permits rearward movement of the upper portion via flexion of the flex portion during application of the rearward force.

In some examples, the structural frame has laterally opposed side edges, and the upper portion includes a curved region extending between the side edges and configured to curve about a rear of the lower leg and inhibit flexure of the upper portion. The flex portion has a generally planar region extending between the side edges and configured to facilitate flexure of the flex portion.

In some examples, the flex portion is disposed below the rear upper edge of the shell.

In some examples, the upper portion has a first lateral extent and the flex portion has a second lateral extent that is less than the first lateral extent.

In some examples, the guard frame is of integral, unitary, one-piece construction.

In some examples, the first material has a first flexural modulus and the second material has a second flexural modulus greater than the first flexural modulus.

In some examples, the second material comprises a fiber reinforced polymer including a matrix material and reinforcing fibers in the matrix material. In some examples, the reinforcing fibers comprise carbon fibers. In some examples, the matrix material comprises epoxy.

According to some aspects, a skate boot includes: (a) a structural shell configured to cover at least a rear and sides of a foot of a wearer, the shell made of a first material; and (b) a tendon guard attached to the shell and configured to protect an Achilles tendon of the wearer, the tendon guard including a structural guard frame made of a second material stiffer than the first material. The guard frame includes a flex portion having sufficient flexibility to permit rearward movement of an upper portion of the guard frame in response to application of a rearward force on the upper portion by a lower leg of the wearer during plantarflexion, and the flex portion has sufficient resiliency to urge the upper portion back toward a resting position when the rearward force is relieved.

According to some aspects, a method of using a skate boot includes: (a) providing a structural shell of the skate boot, the shell formed of a first material and configured to cover at least a rear and sides of a foot of a wearer; (b) providing a tendon guard attached to the shell and configured to protect an Achilles tendon of the wearer, the tendon guard including a structural guard frame formed of a second material stiffer than the first material; (c) applying a rearward force on an upper portion of the guard frame to flex the tendon guard rearwardly about a resilient flex portion of the guard frame and move the upper portion from a resting position toward a rearward position; and (d) relieving the rearward force to permit the flex portion to move the upper portion back to the resting position.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
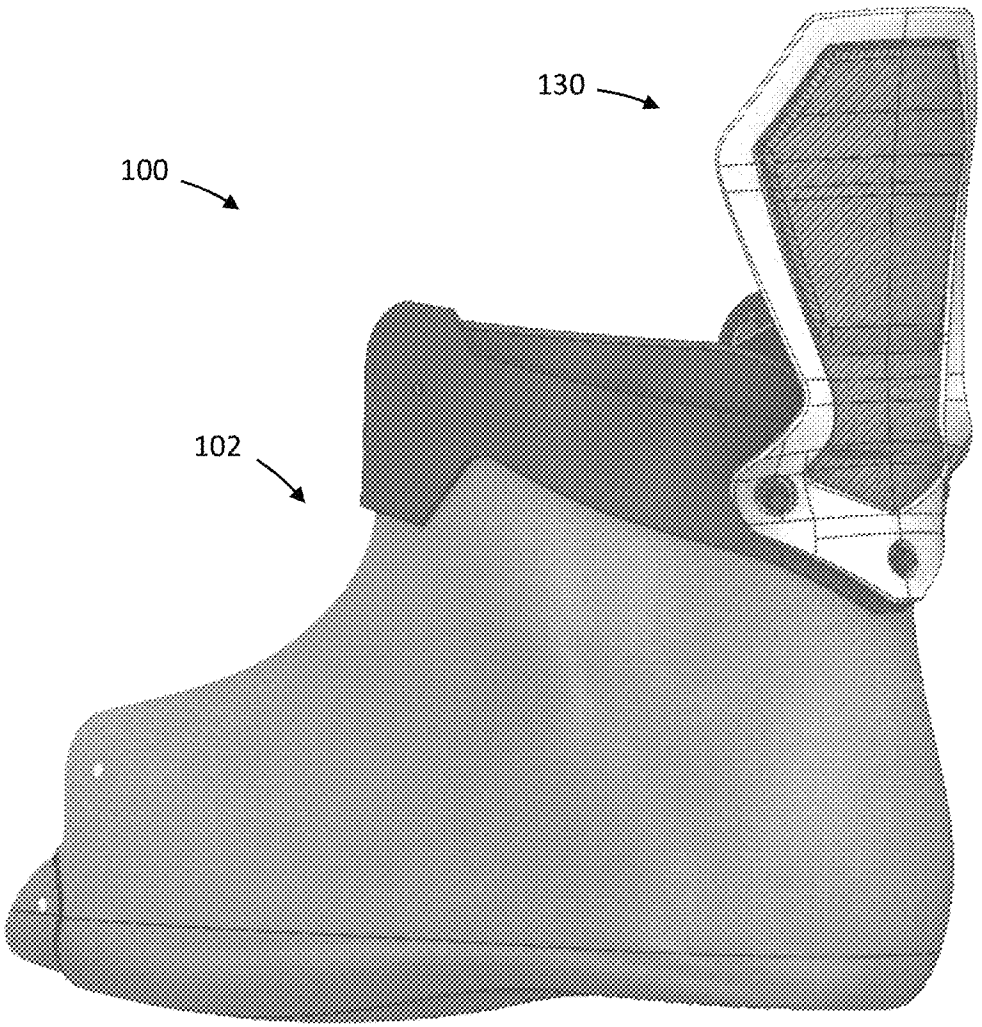
FIG. 1 is a rear perspective view of an example skate boot.
Figure 2:
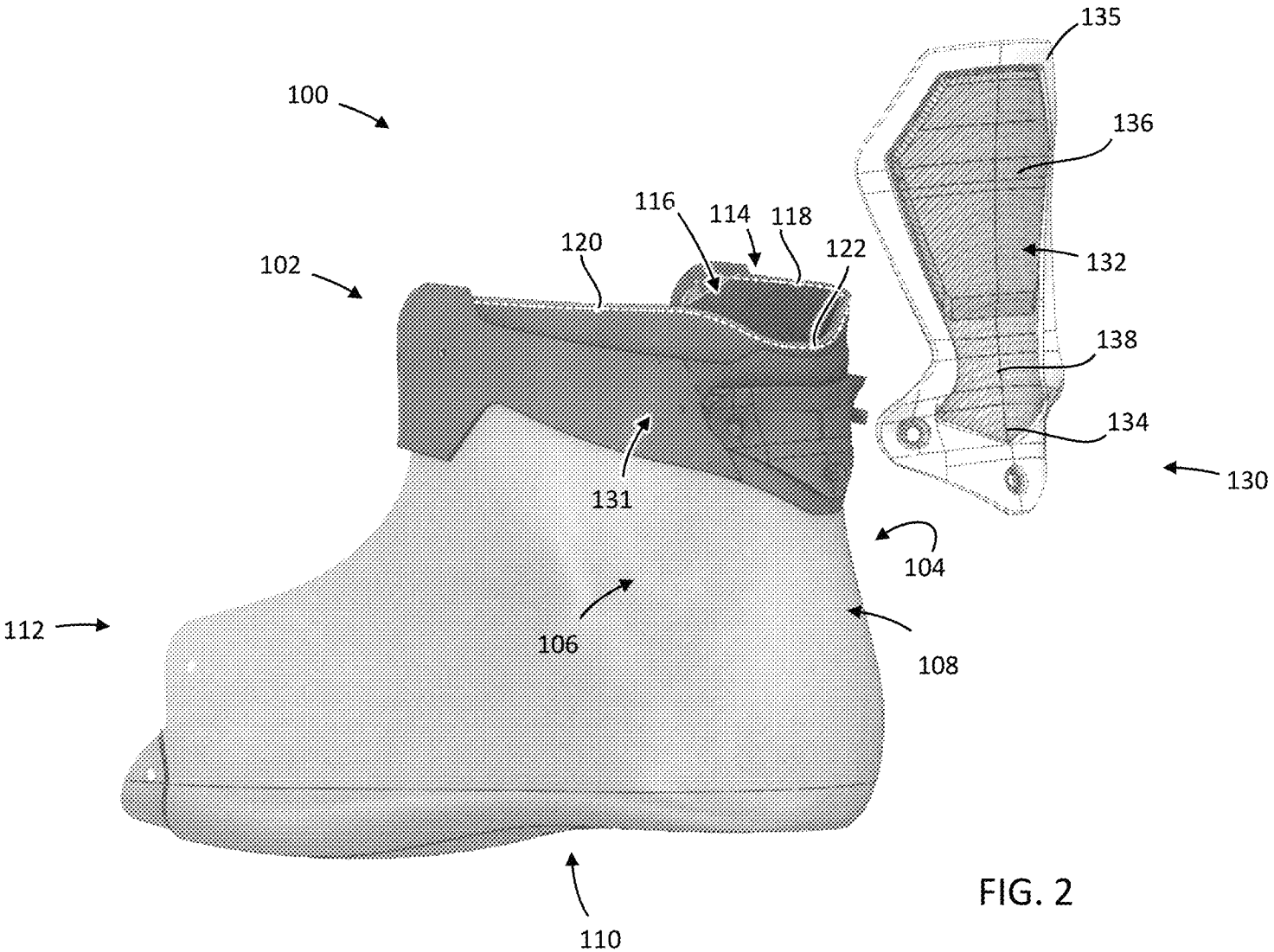
FIG. 2 is a partially exploded view of the skate boot of FIG. 1.
Figure 3:
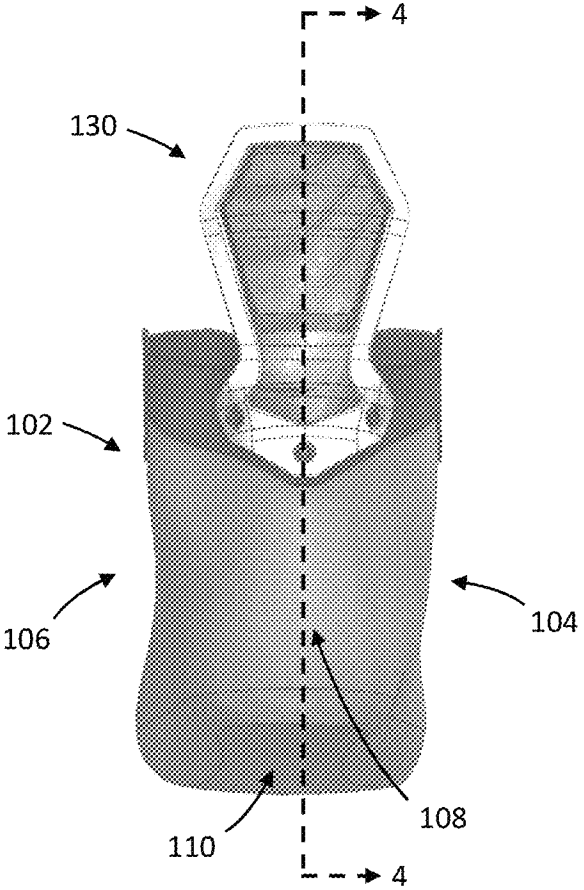
FIG. 3 is a rear view of the skate boot of FIG. 1.

Referring to FIG. 1, an example skate boot 100 for a skate (e.g. an ice or roller skate) is shown. Referring to FIG. 2, the skate boot 100 includes a structural shell 102 configured to cover at least a rear and sides of a foot of a wearer. In the example illustrated, the shell 102 has a shell medial portion 104 for covering a medial side of the foot, a shell lateral portion 106 laterally opposite the medial portion 104 for covering a lateral side of the foot, and a shell rear portion 108 extending laterally between the medial and lateral portions 104, 106 for covering a rear of the foot (see also FIG. 3). In the example illustrated, the shell 102 also includes a shell sole portion 110 extending laterally between the medial and lateral portion 104, 106 and from the rear portion 108 toward a front 112 of the shell 102 for covering at least a portion of a sole of the foot. In the example illustrated, the front 112 of the shell 102 is generally open.

In the example illustrated, the shell 102 has an upper edge 114 defining a boot opening 116 for insertion of the foot. In the example illustrated, the upper edge 114 includes a medial upper edge 118 at the shell medial portion 104, a lateral upper edge 120 at the shell lateral portion 106, and a rear upper edge 122 at the shell rear portion 108 and extending laterally between and joining the medial and lateral upper edges 118, 120.

In the example illustrated, the shell 102 is generally rigid to provide support and protection to at least the sides and rear of the foot (including, for example, the heel, ankle, and lower portions of the Achilles tendon covered by the shell 102). In the example illustrated, the shell 102 is made of a first material. The first material can include a resin such as, for example, a thermoplastic and/or thermosetting polymer. In some examples, the resin can include a thermoplastic ionomer (e.g. Surlyn®), polyethelyne, polypropylene, and/or other suitable resins. In some examples, the first material can include reinforcing fibers in a matrix of the resin. The reinforcing fibers can include, for example, a mesh of polyester and/or nylon and a non-woven polyester, and/or other suitable reinforcing fibers. In some examples, the first material can comprise approximately 50-75% by volume of the resin and approximately 25-50% by volume of reinforcing fibers.

In the example illustrated, the shell 102 is of integral, unitary, one-piece construction. In some examples, the shell 102 can be formed of multiple joined-together pieces and/or layers. Each piece and/or layer may be formed of one or more respective materials, and the materials of the pieces and/or layers can define the first material of the shell 102.

Still referring to FIG. 2, in the example illustrated, the skate boot 100 includes a tendon guard 130 attached to the shell 102 and configured to protect upper portions of an Achilles tendon of the wearer. In the example illustrated, the tendon guard 130 is attached at the rear portion 108 of the shell 102. In the example illustrated, a facing 131 is shown attached to an upper portion of the shell 102, with a rear section of the facing 131 positioned intermediate the shell 102 and the tendon guard 130.

In the example illustrated, the tendon guard 130 includes a structural guard frame 132 having a lower portion 134 attached to the shell 102 and an upper portion 136 extending above the rear upper edge 122 of the shell 102. The upper portion 136 is configured to protect at least a portion the Achilles tendon above the shell 102. In the example illustrated, the tendon guard 130 further includes a trim 135 extending about at least a portion of a periphery the guard frame 132, and padding 137 (FIG. 4) on a front face of the upper portion 136 for comfort.

Figure 4:
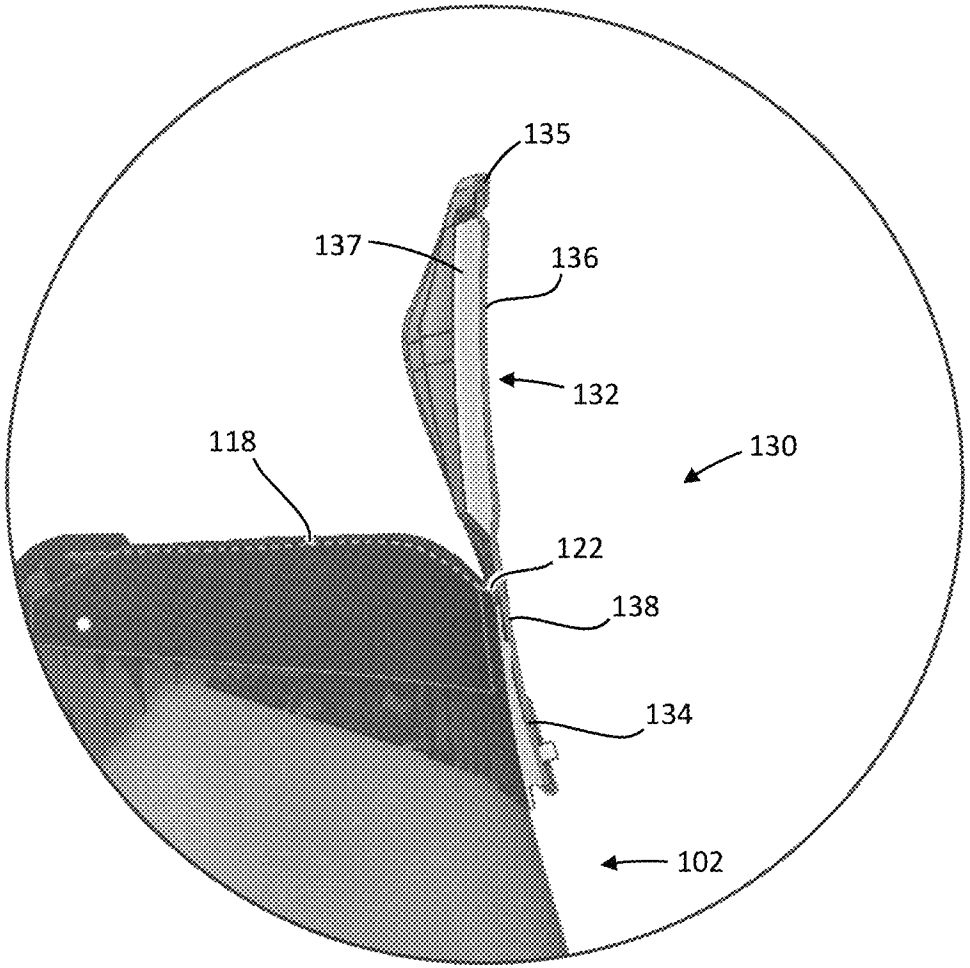
FIG. 4 is a cross-sectional view of a portion of the skate boot of FIG. 1, taken along line 4-4 of FIG. 3 and showing a tendon guard of the skate boot in a resting state.
Figure 5:
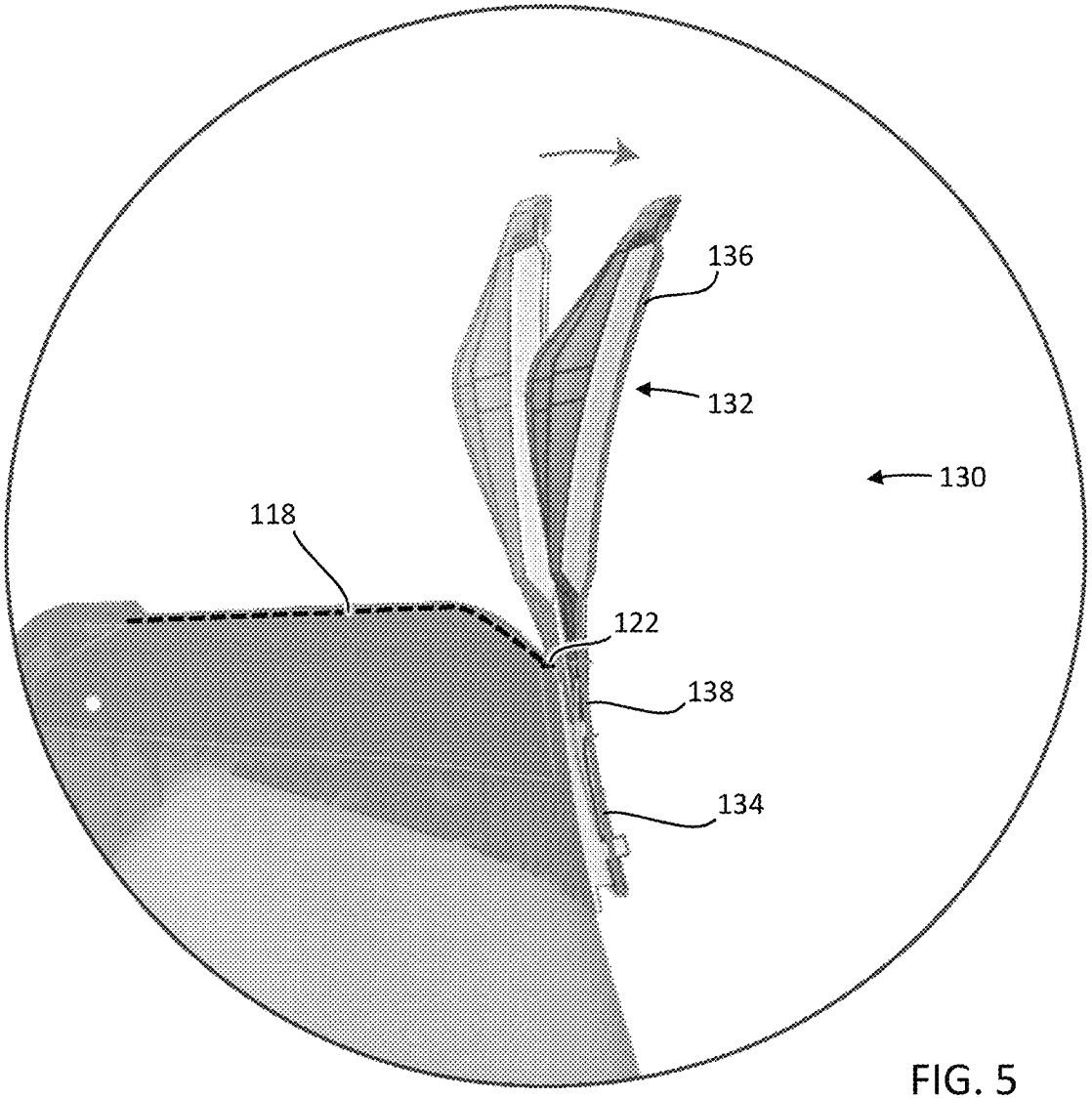
FIG. 5 is a cross-sectional view like that of FIG. 4, but showing the tendon guard in a rearward state.

In the example illustrated, the guard frame 132 includes a flex portion 138 vertically intermediate the lower and upper portions 134, 136. Referring to FIGS. 4 and 5, in the example illustrated, the flex portion 138 has sufficient flexibility to permit rearward movement of the upper portion 136 from a resting position (shown in FIG. 4) toward a rearward position (shown in FIG. 5) in response to application of a rearward force on the upper portion 136 by a lower leg of the wearer during plantarflexion. The flex portion 138 has sufficient resiliency to urge the upper portion 136 back toward the resting position when the rearward force is relieved. In the example illustrated, the flex portion 138 acts as a flexure bearing (in the form of a living hinge, in the example illustrated) between the upper portion 136 and the lower portion 134 of the guard frame 132 (and more generally, between the upper portion 136 and the shell 102 when the tendon guard 130 is mounted to the shell 102).

In the example illustrated, the flex portion 138 is disposed at an elevation below the rear upper edge 122 of the shell 102. This can help to, for example, bring the flex point of the tendon guard closer to the natural flexing point of the ankle, which may help increase comfort when the lower leg is moved rearwardly during plantarflexion. In the example illustrated, the flex portion 138 is disposed at an elevation below a lowermost section of the rear upper edge 122 of the shell 102.

In the example illustrated, the guard frame 132 is made of a second material stiffer than the first material. Forming the guard frame 132 of a stiff material can help to, for example, increase return energy of the flex portion 138 and increase a rate at which the upper portion 136 returns toward the resting position after being moved rearwardly. In the example illustrated, the first material (forming the shell 102) has a first flexural modulus and the second material (forming the guard frame 132) has a second flexural modulus greater than the first flexural modulus.

In some examples, the second material can include a fiber reinforced polymer. The fiber reinforced polymer can include a matrix material such as, for example, epoxy, nylon, acrylic (e.g. Poly(methyl methacrylate), and/or other suitable matrix materials, and reinforcing fibers in the matrix material such as, for example, carbon fibers and/or other suitable reinforcing fibers. In some examples, the second material comprises a carbon fiber reinforced epoxy. In some examples, the second material can comprise approximately 45-55% by volume of the matrix material and 45-55% by volume of the reinforcing fibers.

In the example illustrated, the guard frame 132 is of integral, unitary, one-piece construction. In some examples, the guard frame 132 may be formed of multiple joined-together pieces and/or layers. Each piece and/or layer may be formed of one or more respective materials, and the materials of the pieces and/or layers can define the second material of the guard frame 132.

Figure 8:
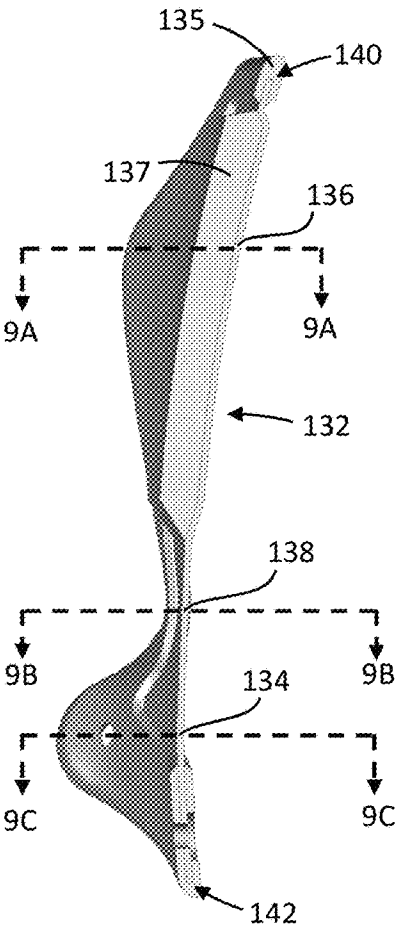
FIG. 8 is a cross-sectional view of the tendon guard portion of FIG. 6, taken along line 8-8 of FIG. 7.
Figure 7:
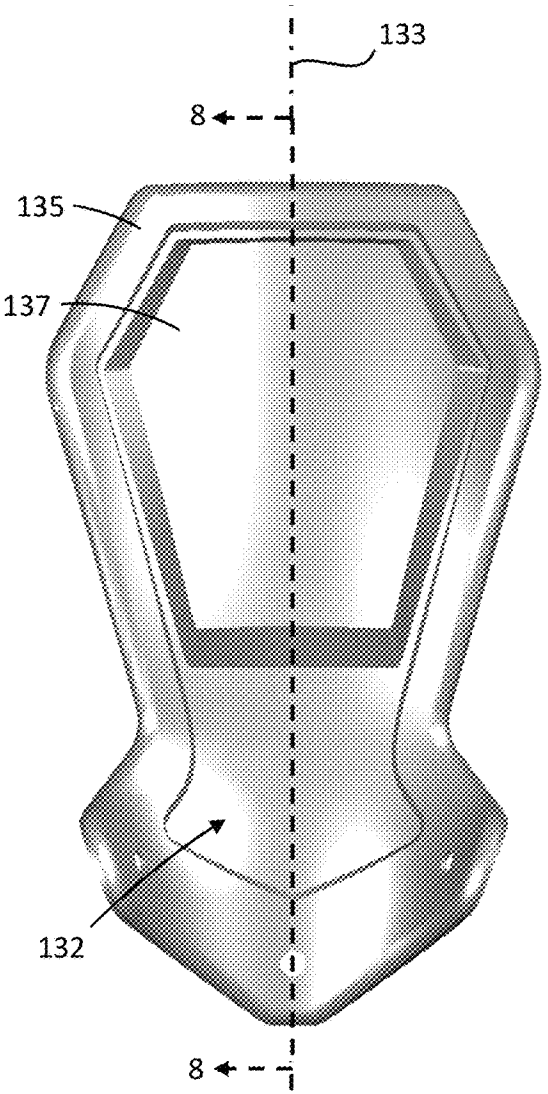
FIG. 7 is a front view of the tendon guard portion of FIG. 6.
Figure 6:
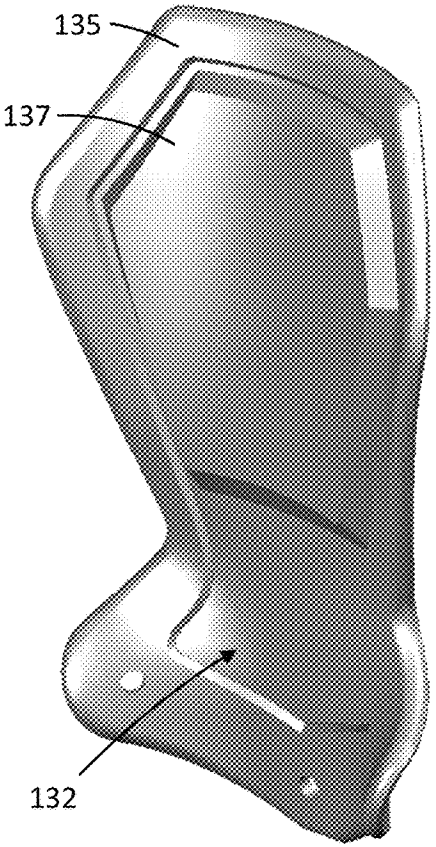
FIG. 6 is a front perspective view of a tendon guard portion of the skate boot of FIG. 1.

Referring to FIGS. 6 to 8, in the example illustrated, the upper portion 136 of the guard frame 132 has a first geometry, and the flex portion 138 has a second geometry having a reduced flexural rigidity relative to the first geometry. In the example illustrated, the first geometry is configured to inhibit flexure of the upper portion 136 during application of the rearward force, and the reduced flexural rigidity of the second geometry permits the rearward movement of the upper portion 136 via flexion of the flex portion 138 during application of the rearward force.

Figure 9C:
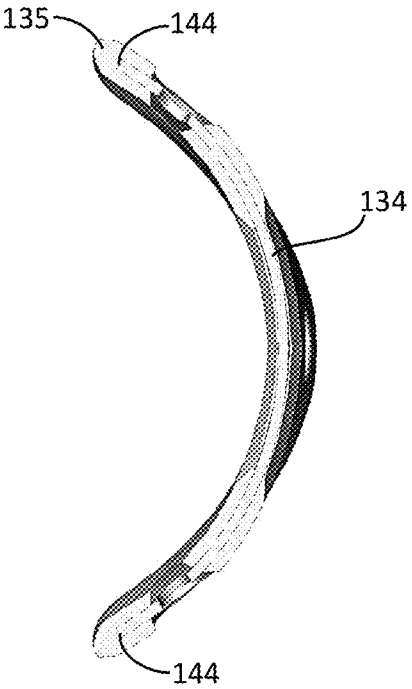
FIG. 9C is another cross-sectional view of the tendon guard portion of FIG. 6, taken along line 9C-9C of FIG. 8.
Figure 9B:
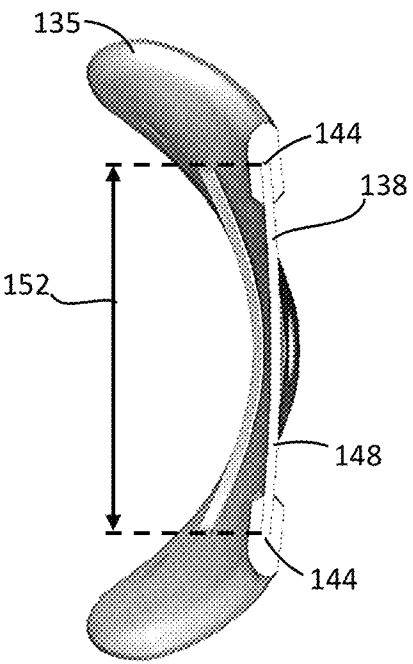
FIG. 9B is another cross-sectional view of the tendon guard portion of FIG. 6, taken along line 9B-9B of FIG. 8.
Figure 9A:
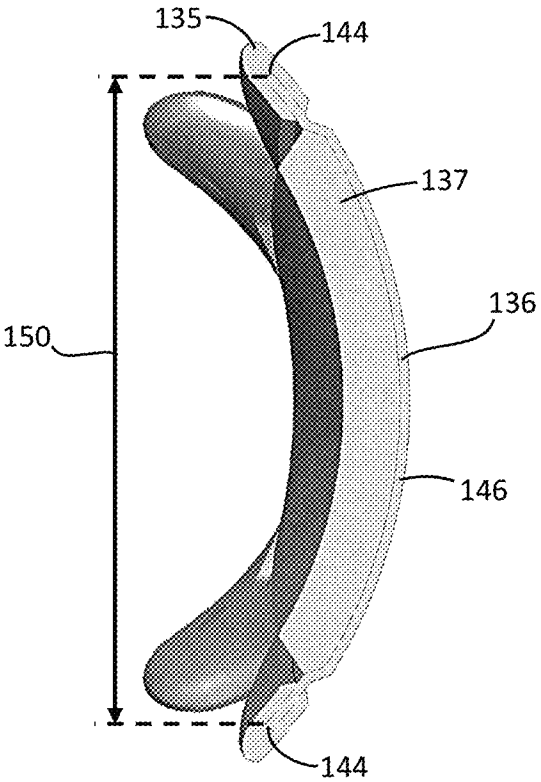
FIG. 9A is another cross-sectional view of the tendon guard portion of FIG. 6, taken along line 9A-9A of FIG. 8.

Referring to FIG. 8, in the example illustrated, the guard frame 132 extends along a longitudinal axis 133 (FIG. 7) between an upper end 140 and a lower end 142. Referring to FIGS. 9A to 9C, the guard frame 132 has laterally spaced apart side edges 144 extending between the upper and lower ends 140, 142 (FIG. 8). Referring to FIG. 9A, in the example illustrated, the upper portion 136 of the guard frame 132 has a curved region 146 extending between the side edges 144 and configured to curve about a rear of the lower leg and inhibit flexure of the upper portion 136 in use. Referring to FIG. 9B, in the example illustrated, the flex portion 138 has a generally planar region 148 extending between the side edges 144 and configured to facilitate flexure of the flex portion 138 in use. In the example illustrated, the upper portion 136 has a first lateral extent 150 (FIG. 9A) between the side edges 144, and the flex portion 138 has a second lateral extent 152 (FIG. 9B) that is less than the first lateral extent 150.

In some examples, one or more other ice and/or roller skate components may be attached to the shell 102, including, for example, an outsole (in addition to or in lieu of the shell sole portion 110) for attaching a blade or roller assembly, an insole, liners, a toe cap for covering toes of the foot, a tongue attached to the toe cap for covering an instep of the foot, etc.

Figure 10:
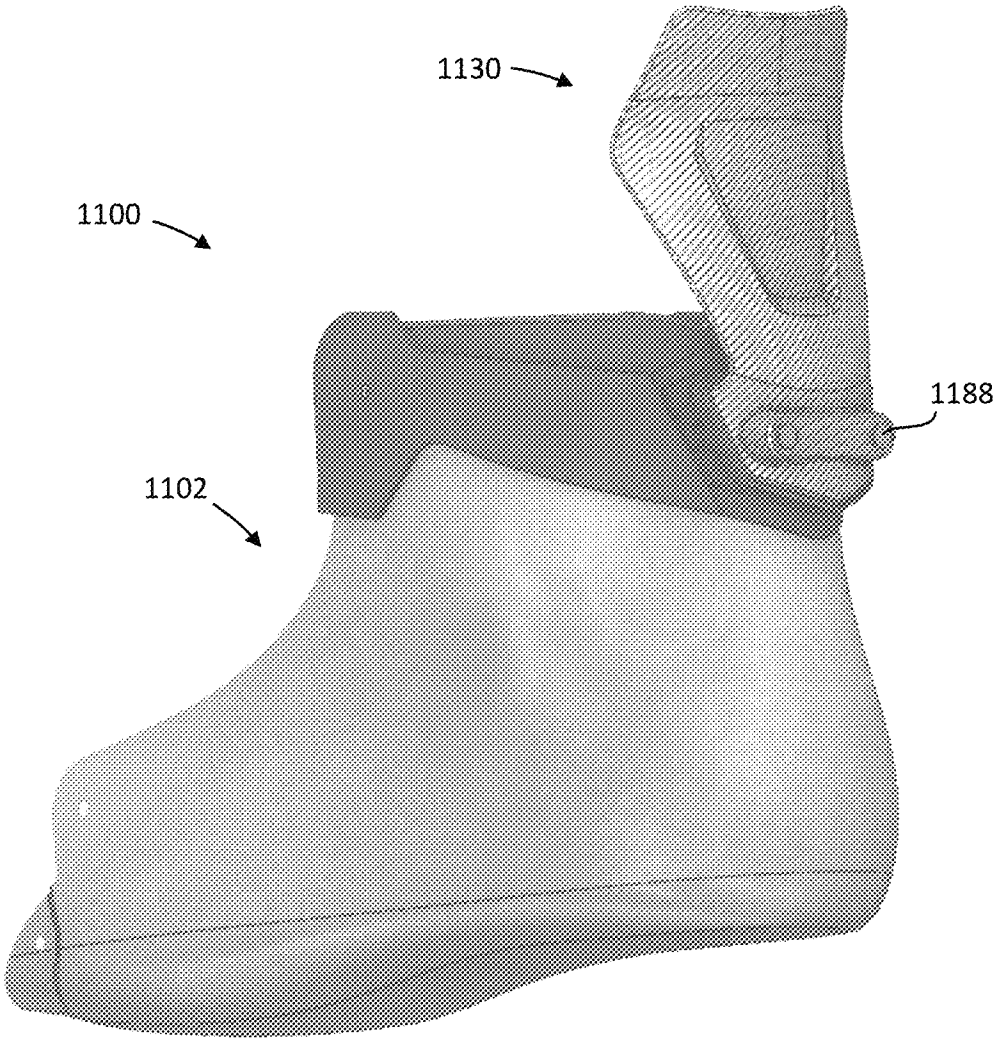
FIG. 10 is a rear perspective view of another example skate boot.

FIG. 10 shows another example skate boot 1100. The skate boot 1100 has similarities to the skate boot 100, and like features are identified with like reference characters, incremented by 1000.

Figure 11:
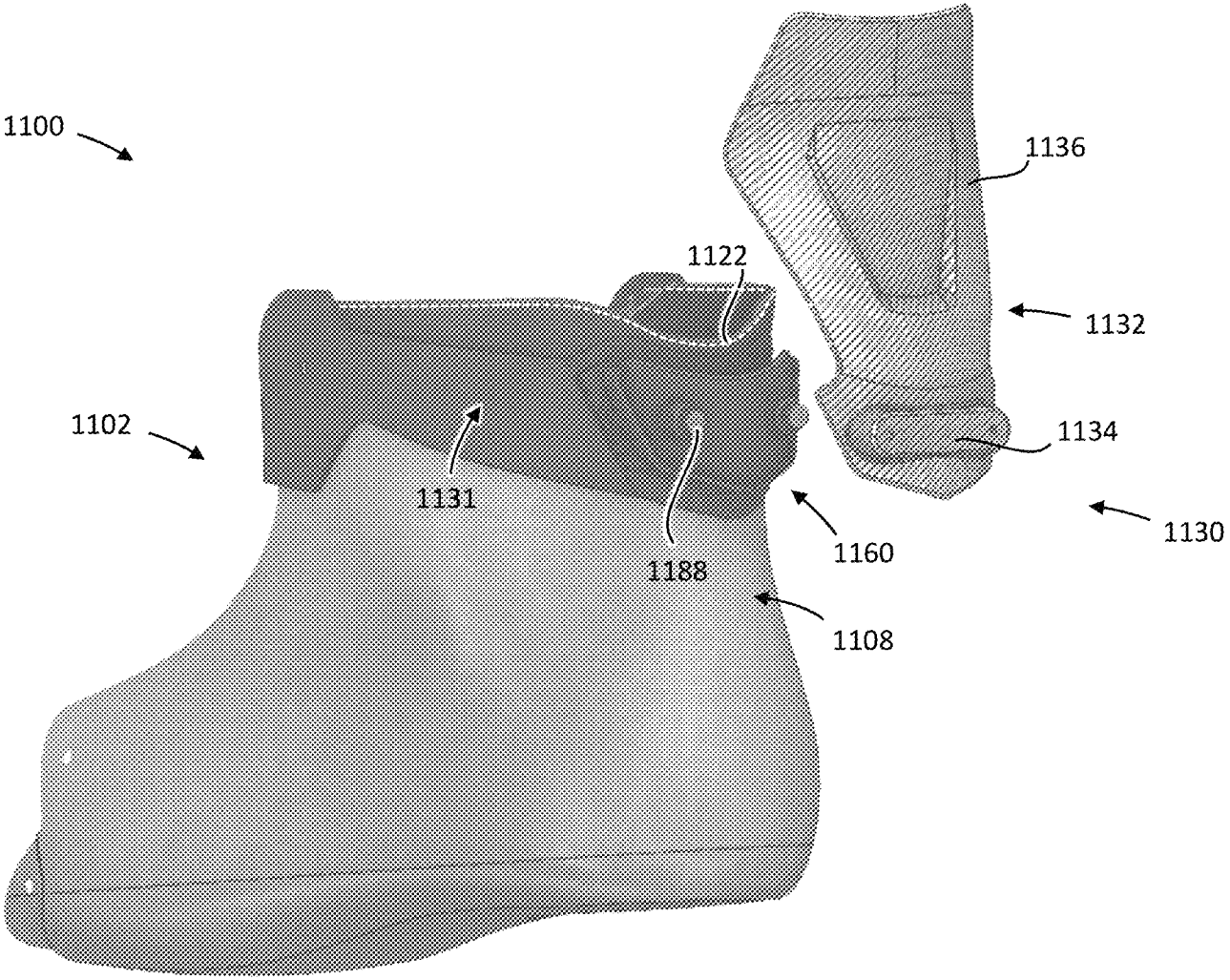
FIG. 11 is a partially exploded view of the skate boot of FIG. 10.

Referring to FIG. 11, in the example illustrated, the skate boot 1100 includes a structural shell 1102 configured to cover at least a rear and sides of a foot of a wearer. In the example illustrated, the shell 1102 is generally rigid to provide support and protection to at least the sides and rear of the foot (including, for example, the heel, ankle, and lower portions of the Achilles tendon covered by the shell 1102).

In the example illustrated, the skate boot 1100 further includes a tendon guard 1130 attached to the shell 1102 and configured to protect upper portions of an Achilles tendon of the wearer. In the example illustrated, the tendon guard 1130 is attached at a shell rear portion 1108 of the shell 1102.

In the example illustrated, the tendon guard 1130 includes a structural guard frame 1132 having a lower portion 1134, and an upper portion 1136 extending above a rear upper edge 1122 of the shell 1102 and configured to protect at least a portion of the Achilles tendon above the shell. In some examples, the tendon guard 1130 can include a trim (not shown in FIG. 11) extending about at least a portion of a periphery of the guard frame 1132, and padding (not shown in FIG. 11) on a front face of the upper portion 1136 for comfort. In the example illustrated, the guard frame 1132 is of integral, unitary, one-piece construction.

Figure 13:
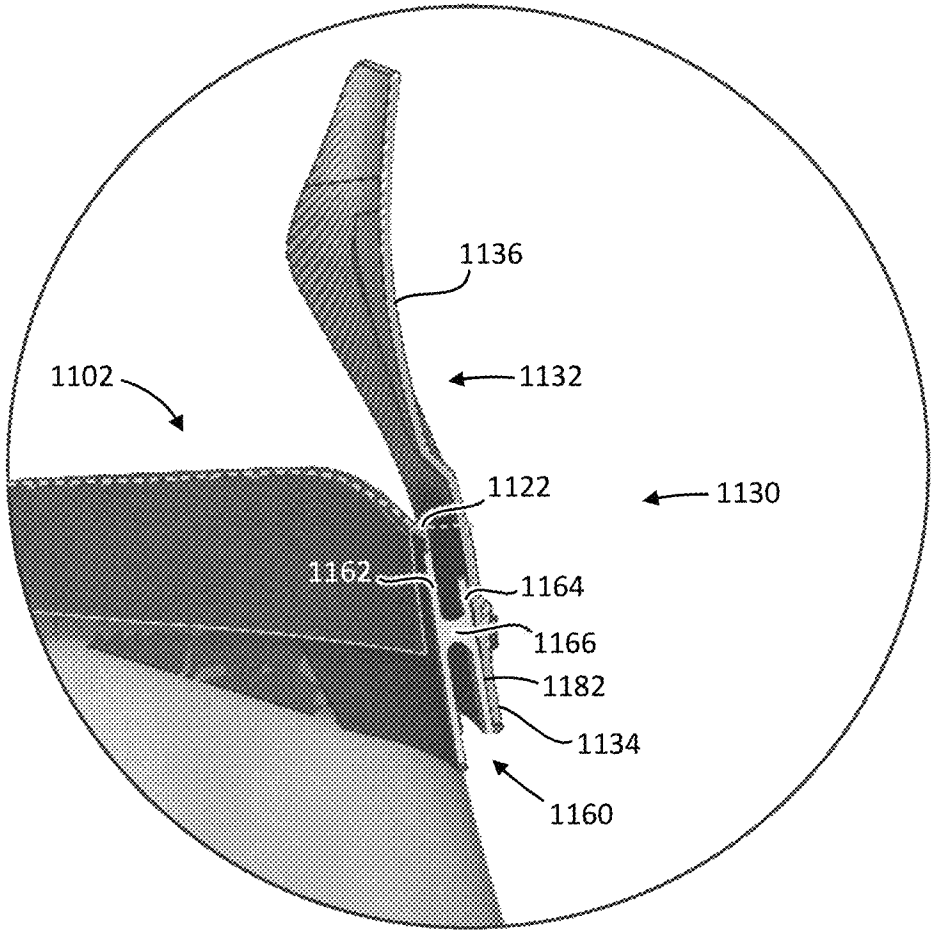
FIG. 13 is a cross-sectional view of a portion of the skate boot of FIG. 10, taken along line 13-13 of FIG. 12 and showing a tendon guard of the skate boot in a resting state.
Figure 12:
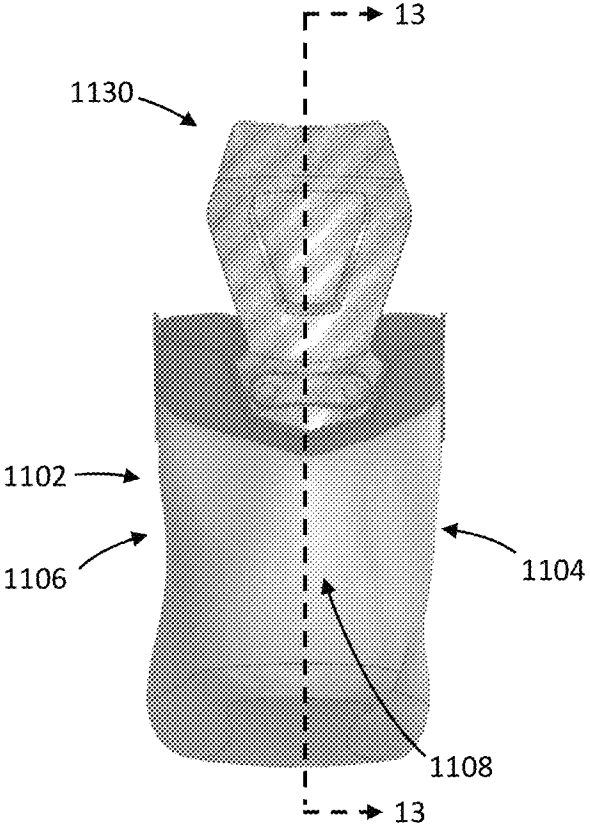
FIG. 12 is a rear view of the skate boot of FIG. 10.

In the example illustrated, the skate boot 1100 further includes a mount 1160 joining the guard frame 1132 to the shell 1102. Referring to FIG. 13, in the example illustrated, the mount 1160 has a mount front portion 1162 attached to the shell 1102, a mount rear portion 1164 spaced rearwardly from the front portion 1162 and attached to the lower portion 1134 of the guard frame 1132, and a mount flex portion 1166 intermediate and joining the front and rear portions 1162, 1164.

Figure 14:
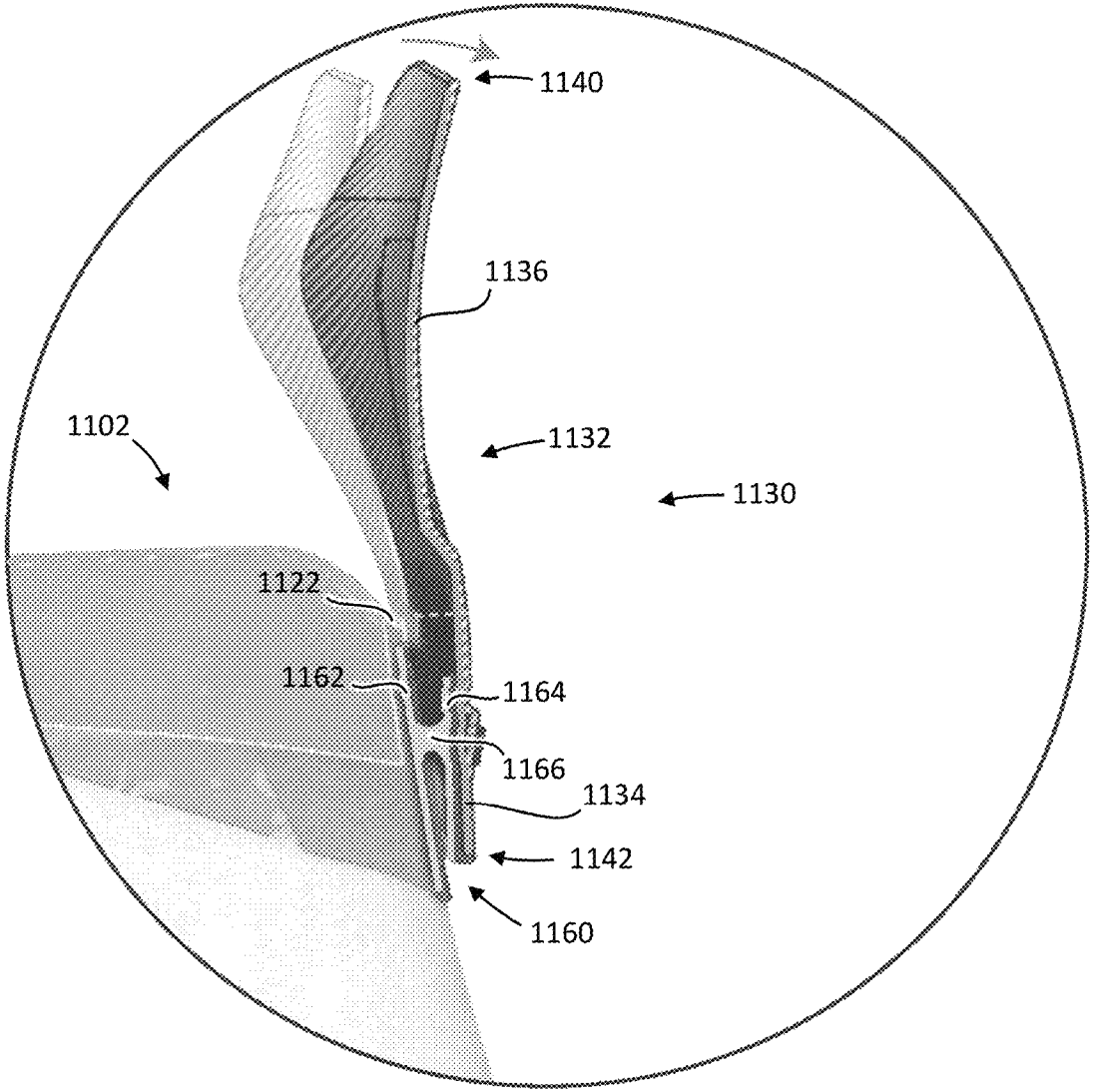
FIG. 14 is a cross-sectional view like that of FIG. 13, but showing the tendon guard in a rearward state.
Figure 17:
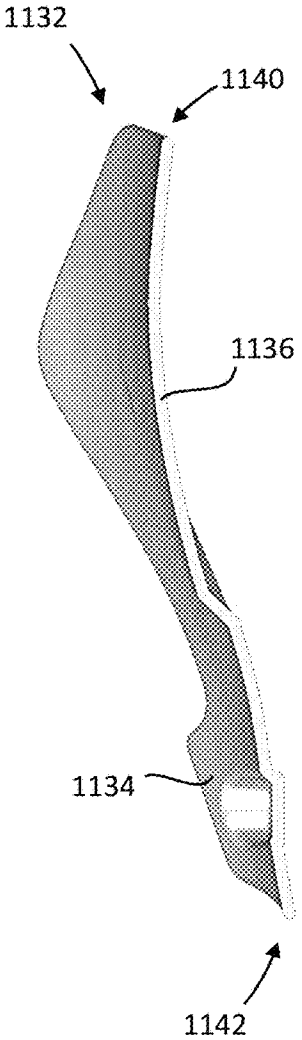
FIG. 17 is a cross-sectional view of the tendon guard frame structure of FIG. 15, taken along line 17-17 of FIG. 16.

Referring to FIGS. 13 and 14, in the example illustrated, the flex portion 1166 has sufficient flexibility to permit rearward movement of the upper portion 1136 of the guard frame 1132 from a resting position (shown in FIG. 13) toward a rearward position (shown in FIG. 14) in response to application of a rearward force on the upper portion by a lower leg of the wearer during plantarflexion. The flex portion 1166 has sufficient resiliency to urge the upper portion 1136 back toward the resting position when the rearward force is relieved. In the example illustrated, the flex portion 1166 acts as a flexure bearing (in the form of a living hinge, in the example illustrated) between the mount front portion 1162 and the mount rear portion 1164 (and more generally, between the guard frame 1132 and the shell 1102 when the tendon guard 1130 is mounted to the shell 1102). In the example illustrated, the flex portion 1166 is disposed at an elevation below the rear upper edge 1122 of the shell 1102. In the example illustrated, the flex portion 1166 is disposed at an elevation below a lowermost section of the rear upper edge 1122 of the shell 1102.

In the example illustrated, the mount 1160 is of integral, unitary, one-piece construction. In some examples, the mount 1160 may be overmolded on or formed integrally with a facing 1131 (FIG. 11) attached to an upper portion of the shell 1102. In the example illustrated, the shell 1102 can be made of a first material, the guard frame 1132 can be made of a second material, and at least the flex portion 1166 of the mount 1160 can be made of a third material. In the example illustrated, the third material can be selected to facilitate flexion and resilience of the flex portion 1166 for movement of the upper portion 1136 between the resting and rearward positions. The third material can comprise an elastomer such as, for example, Hytrel®, thermoplastic polyurethane, thermoplastic rubber, ethylene-vinyl acetate, rubber, and/or other suitable elastomers and/or thermoplastic elastomers.

In the example illustrated, the second material and geometry of the guard frame 1132 can provide the guard frame 1132 with sufficient stiffness to inhibit flexion of the guard frame 1132 during movement between the resting and rearward positions. In the example illustrated, the second material (forming the guard frame 1132) is stiffer than the third material (forming the flex portion 1166). In the example illustrated, the second material is stiffer than the first material (forming the shell 1102). In some examples, the first material (forming the shell 1102) can be similar to the first material described with respect to the shell 102, and the second material (forming the guard frame 1132) can be similar to the second material described with respect to the guard frame 132.

Figure 16:
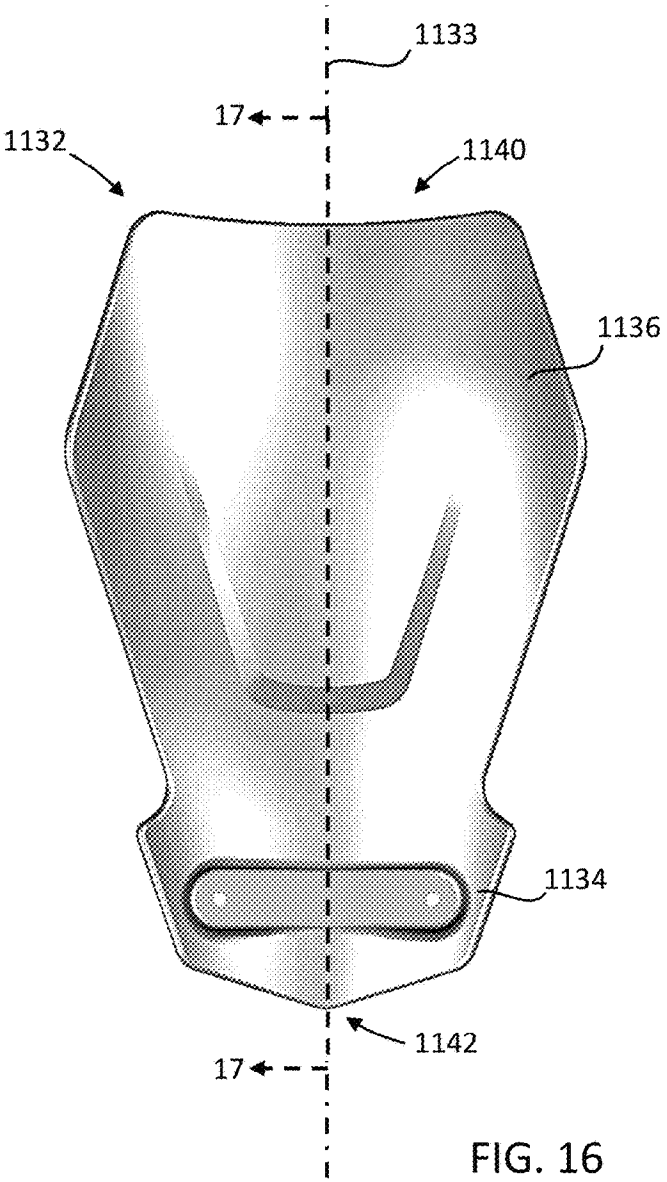
FIG. 16 is a front view of the tendon guard frame structure of FIG. 15.

Referring to FIG. 14, in the example illustrated, the guard frame 1132 extends along a longitudinal axis 1133 (FIG. 16) between an upper end 1140 and a lower end 1142, and the flex portion 1166 of the mount 1160 is vertically intermediate the upper portion 1136 and the lower end 1142 of the guard frame 1132.

Figure 20:
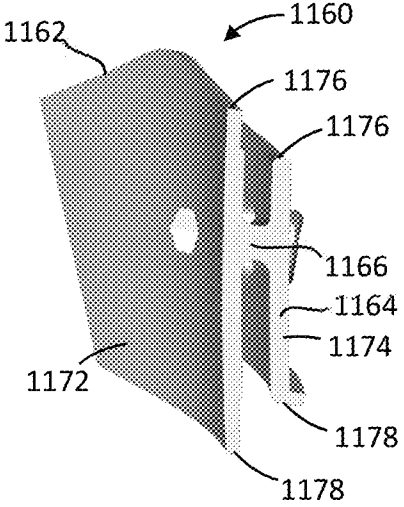
FIG. 20 is a cross-sectional view of the mount portion of FIG. 18, taken along line 20-20 of FIG. 19.
Figure 19:
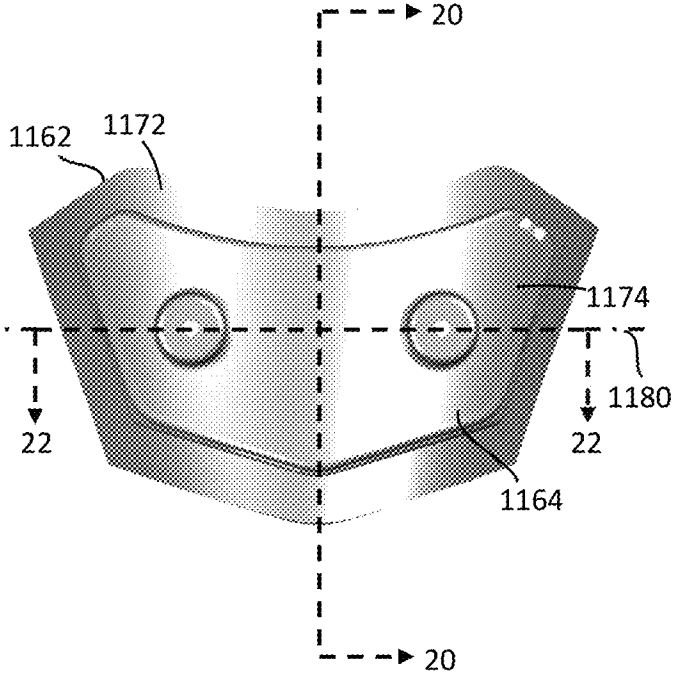
FIG. 19 is a rear view of the mount portion of FIG. 18.
Figure 18:
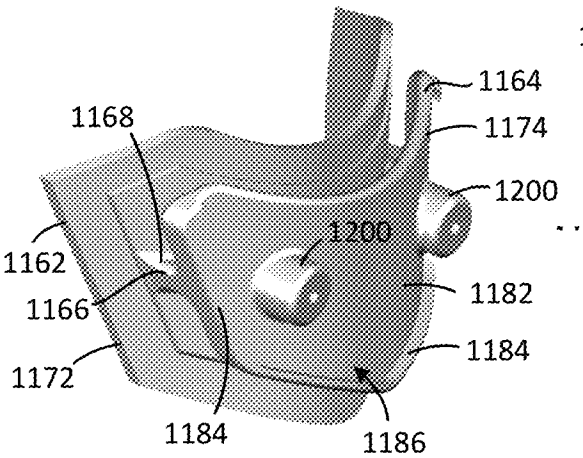
FIG. 18 is a rear perspective view of a mount portion of the skate boot of FIG. 10.

Referring to FIGS. 18 to 20, in the example illustrated, the front portion 1162 of the mount 1160 comprises a front panel 1172, the rear portion 1164 comprises a rear panel 1174, and the flex portion 1166 comprises a beam member 1168 extending substantially horizontally between the front and rear panels 1172, 1174. In the example illustrated, the front panel 1172 is oriented generally vertically, and the flex portion 1166 is oriented generally horizontally. In the example illustrated, the rear panel 1174 is oriented generally vertically. Referring to FIG. 20, in the example illustrated, each of the front panel 1172 and the rear panel 1174 has a respective upper edge 1176 and a respective lower edge 1178 vertically opposite the upper edge 1176, and the flex portion 1166 is vertically intermediate the upper and lower edges 1176, 1178 of the front and rear panels 1172, 1174. This configuration provides the mount 1160 with a generally H-shaped cross section in a plane normal to a lateral axis 1180 (FIG. 19). In some examples, the mount 1160 may have a different cross-sectional shape.

Figure 21:
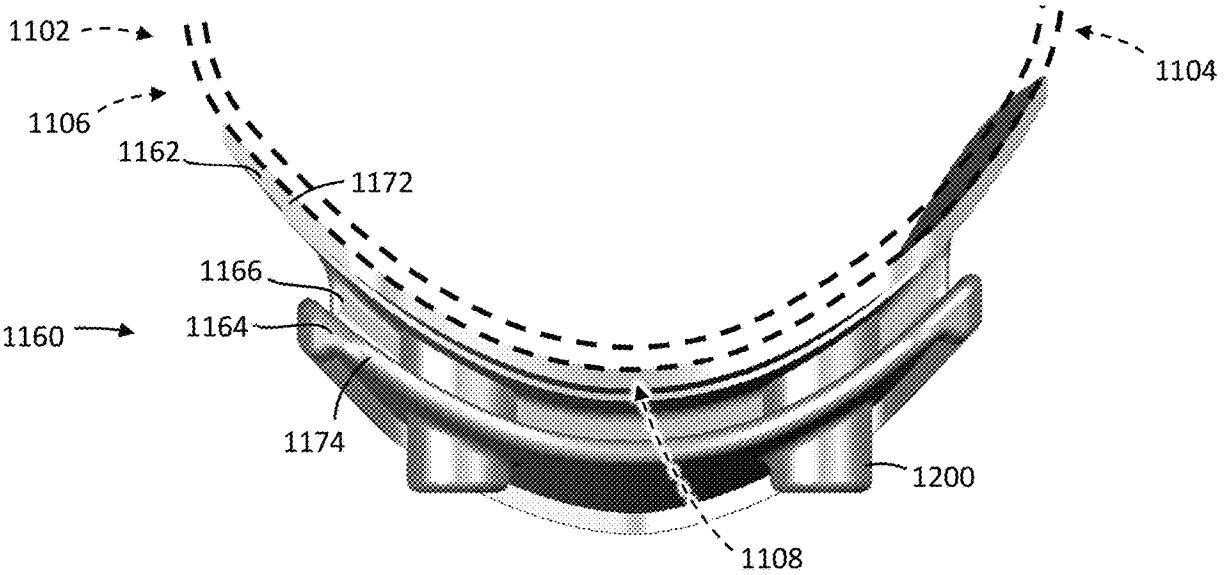
FIG. 21 is a top view of the mount portion of FIG. 18.

Referring to FIG. 21 in the example illustrated, the flex portion 1166 has a generally arcuate geometry curving around the rear portion 1108 of the shell 1102 between lateral and medial portions 1104, 1106 of the shell 1102 (a portion of which is shown schematically in dashed lines in FIG. 21). In some examples, this can help to, for example, increase return energy of the flex portion 1166 and increase a rate at which the upper portion 1136 (FIG. 14) returns toward the resting position after being moved rearwardly. In the example illustrated, each of the front panel 1172, the rear panel 1174, and the flex portion 1166 curve around the shell rear portion 1108 between the lateral and medial portions 1104, 1106.

Referring to FIG. 18, in the example illustrated, the rear portion 1164 of the mount 1160 has a rearwardly directed face 1182 and the lower portion 1134 of the guard frame 1132 is mounted against the rearwardly directed face 1182 (see also FIG. 13). In the example illustrated, the rear portion 1164 has one or more wall portions 1184 extending along bottom and laterally opposed sides of the rearwardly directed face 1182 and defining a recess 1186 in the rearwardly directed face 1182 for receiving the lower portion 1134 of the guard frame 1132.

Figure 22:
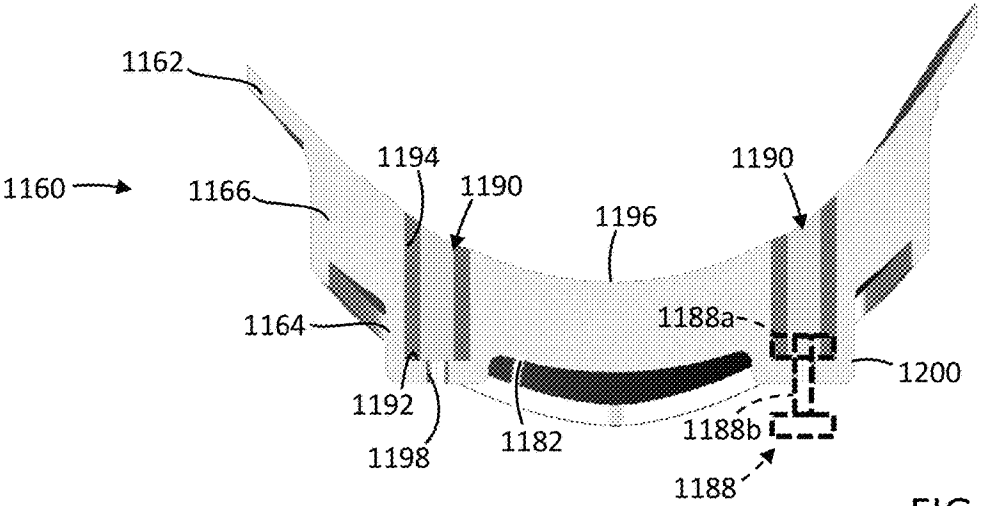
FIG. 22 is another cross-sectional view of the mount portion of FIG. 18, taken along line 22-22 of FIG. 19.

The guard frame 1132 can be secured to the mount 1160 via, for example, fasteners, glue, stiches, interlocking mechanical components, and/or using other suitable methods. Referring to FIG. 11, in the example illustrated, the guard frame 1132 is secured to the mount 1160 via one or more fasteners 1188 (see also FIG. 10). Referring to FIG. 22, each fastener 1188 (one of which is shown schematically in dashed lines in FIG. 22) can include a fastener first portion **1188*a* received in the rear portion 1164 of the mount 1160 and a fastener second portion 1188*b*** extending from the lower portion of the guard frame and into the rear portion 1164 of the mount 1160 for secure engagement with the fastener first portion 1188*a*. In the example illustrated, the fastener first portion 1188*a* includes a nut and the fastener second portion 1188*b* includes a bolt. In other examples, the fasteners 1188 can comprise, for example, screws, rivets, etc.

In the example illustrated, the mount 1160 includes at least one mount hole 1190 (in the form of a counterbored through-hole, in the example illustrated) extending therethrough and having a forward-facing step surface 1192 in the rear portion 1164 of the mount 1160. In the example illustrated, the mount 1160 includes a pair of laterally spaced apart through-holes 1190. In the example illustrated, each through-hole 1190 has a counterbore 1194 open to a front face 1196 of the front portion 1162 and extending rearwardly through the front and flex portions 1162, 1166 to the step surface 1192, and a concentric bore 1198 extending between the step surface 1192 and the rearwardly directed face 1182 of the rear portion 1164. In the example illustrated, the fastener first portion 1188*a* is received in the counterbore 1194 in engagement with the step surface 1192, and the fastener second portion 1188*b* extends from the guard frame 1132 through the concentric bore 1198 for secure engagement with the fastener first portion 1188*a*. The portion of the through-hole 1190 extending across the flex portion 1166 is free of fastener components to facilitate flexion of the flex portion 1166.

Figure 15:
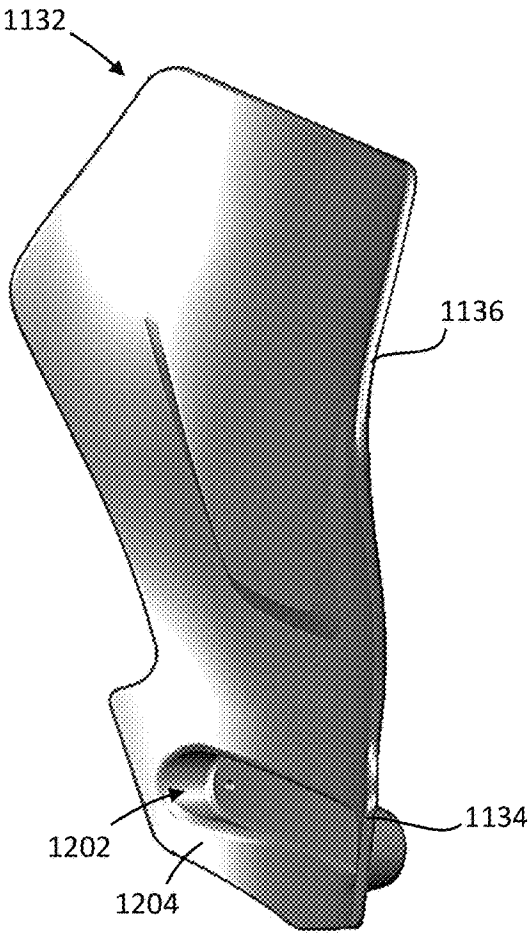
FIG. 15 is a front perspective view of a tendon guard frame structure of the skate boot of FIG. 10.

Referring to FIG. 18, in the example illustrated, the rearwardly directed face 1182 has one or more rearwardly extending projections 1200. Referring to FIG. 15, the guard frame 1132 has one or more complementary cavities 1202 in a front face 1204 of the lower portion 1134 for receiving the projections 1200 (FIG. 18). Referring to FIG. 22, in the example illustrated, each through-hole 1190 passes through a respective projection 1200. The projections 1200 can, for example, facilitate mounting (e.g. positioning) of the guard frame 1132 on the mount 1160 and force transfer therebetween. In some examples, the projections 1200 may be omitted (e.g. where the guard frame 1132 and mount 1160 are glued together).

Figure 23:
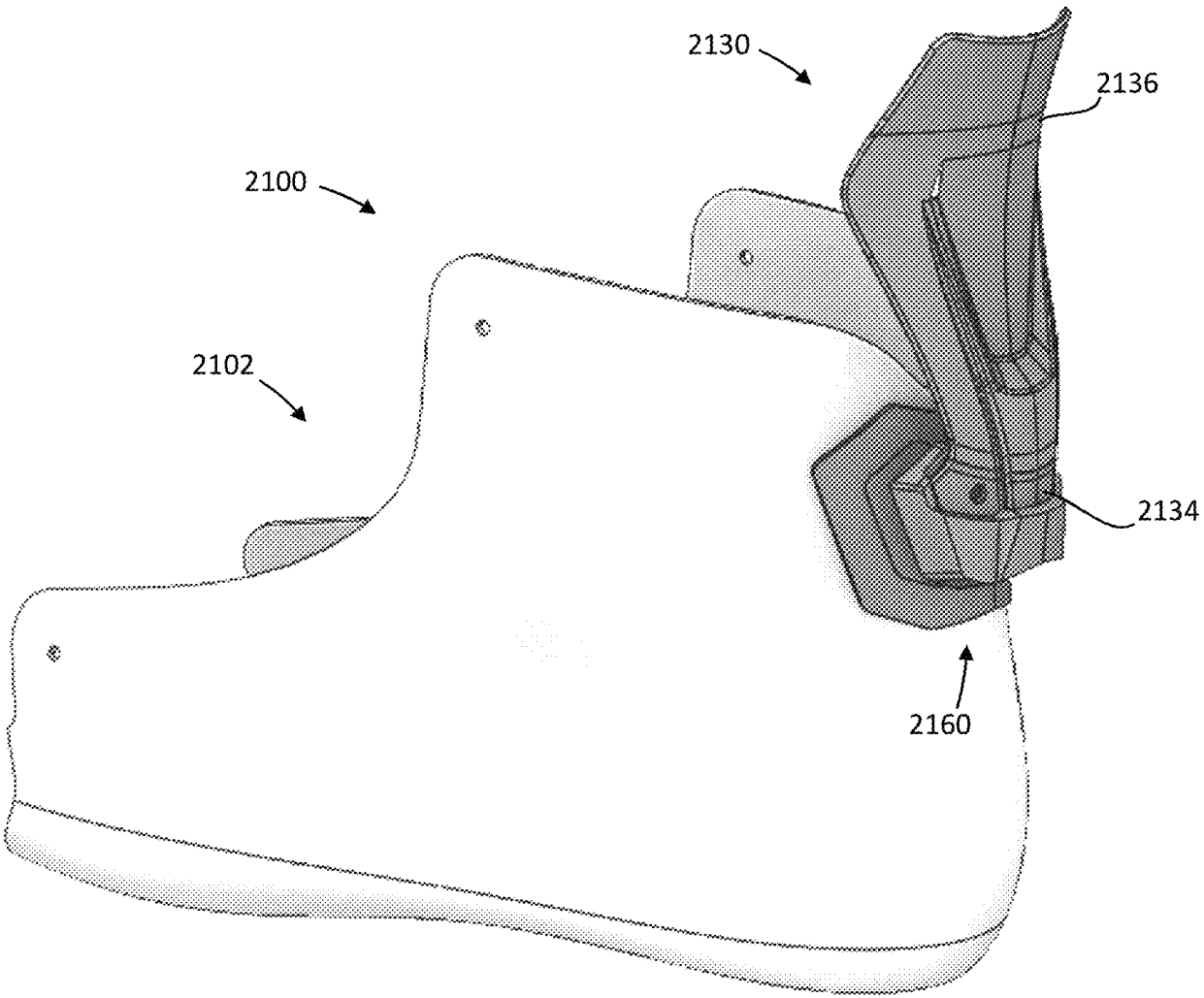
FIG. 23 is a rear perspective view of another example skate boot.

FIG. 23 shows another example skate boot 2100. The skate boot 2100 has similarities to the skate boot 1100, and like features are identified with like reference characters, incremented by 1000. In the example illustrated, the skate boot 2100 includes a structural shell 2102 and a tendon guard 2130 attached to the shell 2102.

Figure 24:
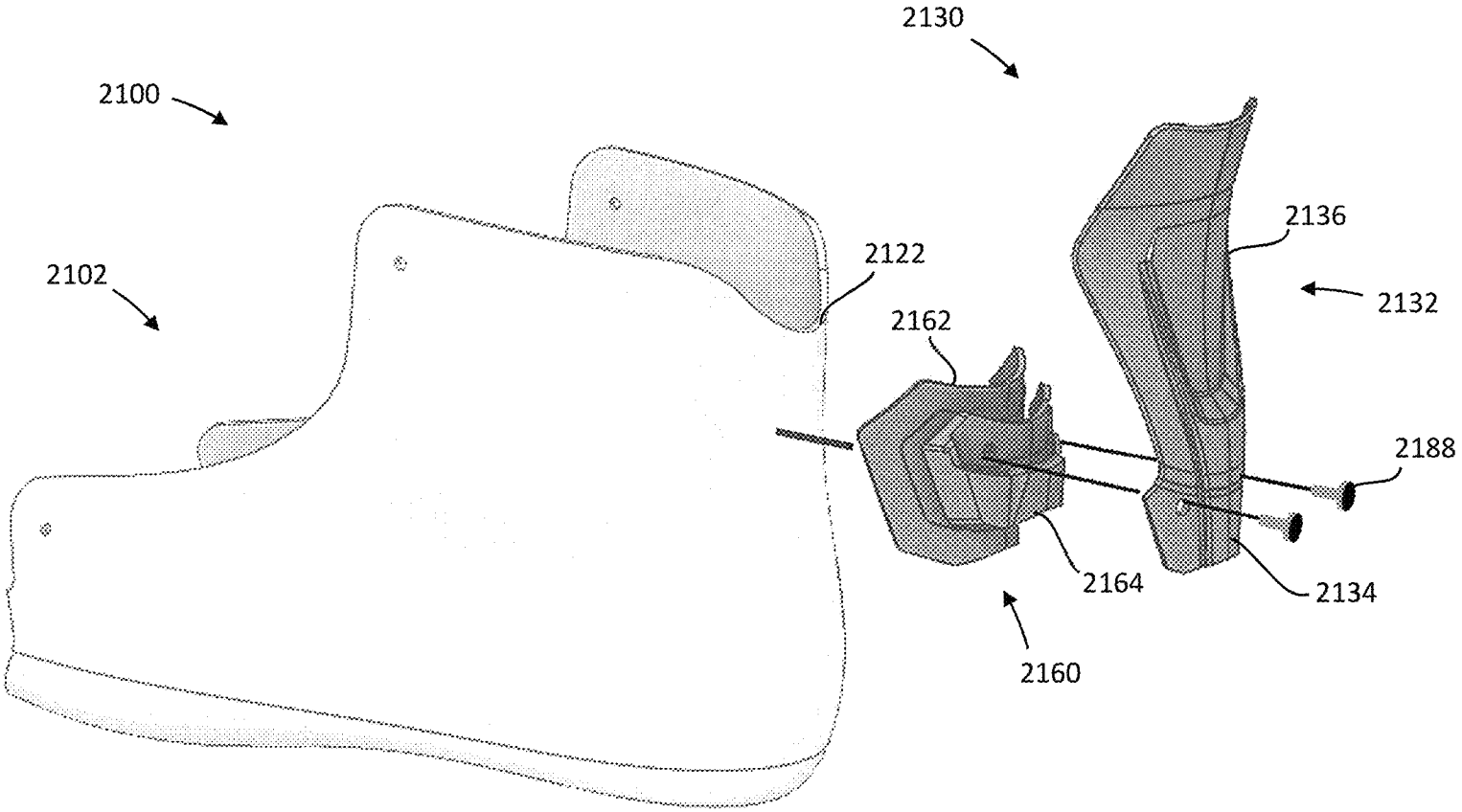
FIG. 24 is an exploded view of the skate boot of FIG. 23.

Referring to FIG. 24, in the example illustrated, the tendon guard 2130 includes a structural guard frame 2132 having a lower portion 2134, and an upper portion 2136 extending above a rear upper edge 2122 of the shell 2102 and configured to protect at least a portion of the Achilles tendon above the shell.

Figure 26:
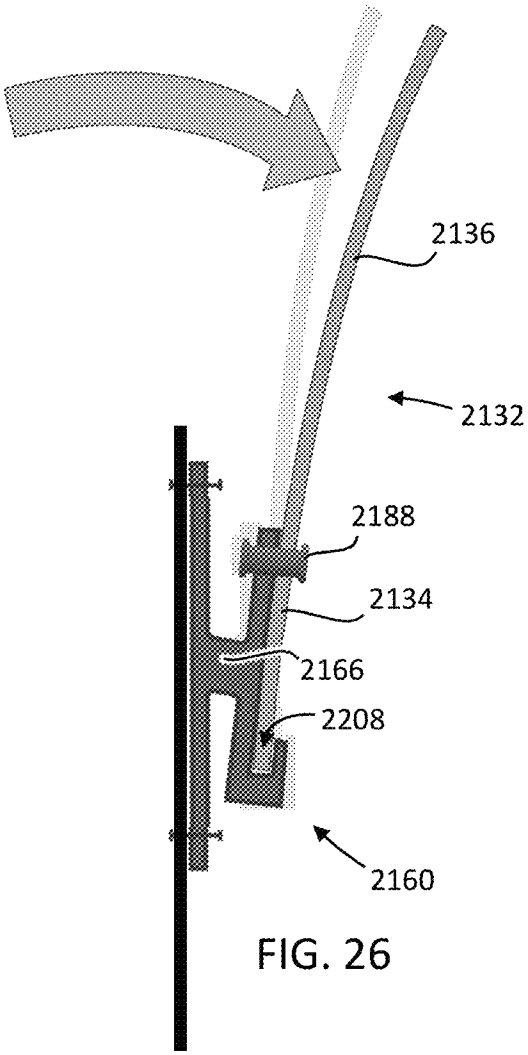
FIG. 26 is a schematic side view like that of FIG. 25, but showing the tendon guard in a rearward state.
Figure 25:
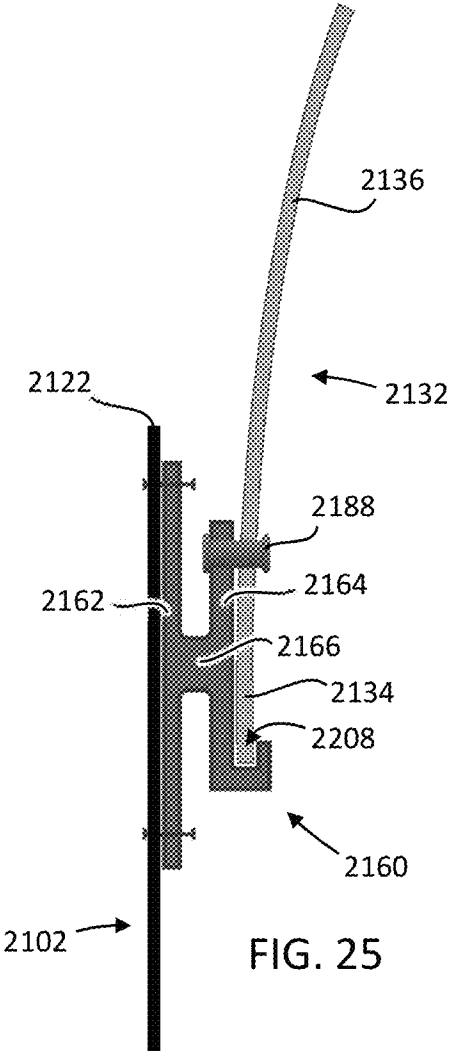
FIG. 25 is a schematic side view of a portion of the skate boot of FIG. 23, showing a tendon guard of the skate boot in a resting state.

In the example illustrated, the skate boot 2100 further includes a mount 2160 joining the guard frame 2132 to the shell 2102. Referring to FIGS. 25 and 26, the mount 2160 includes a mount flex portion 2166 having sufficient flexibility to permit rearward movement of the upper portion 2136 of the guard frame 2132 from a resting position (shown in FIG. 25) toward a rearward position (shown in FIG. 26) in response to application of a rearward force on the upper portion 2136 by a lower leg of the wearer during plantarflexion. The mount flex portion 2166 has sufficient resiliency to urge the upper portion 2136 back toward the resting position when the rearward force is relieved. In the example illustrated, the mount 2160 has a mount front portion 2162 attached to the shell 2102 and a mount rear portion 2164 spaced rearwardly from the front portion 2162 and attached to the lower portion 2134 of the guard frame 2132. The mount flex portion 2166 is intermediate and joins the front and rear portions 2162, 2164.

Figure 33:
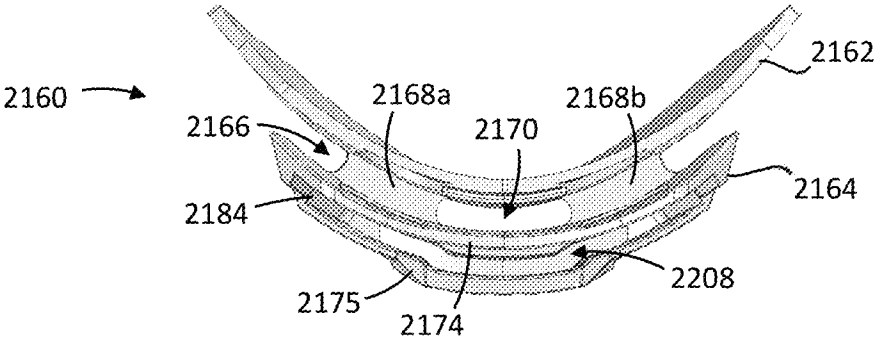
FIG. 33 is a top view of the mount portion of FIG. 30.

Referring to FIG. 33, in the example illustrated, the mount flex portion 2166 comprises a plurality of laterally spaced apart beam members 2168 each extending between and joining the front portion 2162 and the rear portion 2164. When the tendon guard 2130 is mounted, a first one of the beam members 2168*a* is offset toward a lateral side of the skate boot 2100 and a second one of the beam members 2168*b* is offset toward a medial side of the skate boot 2100, and a gap 2170 is provided between the beam members 2168*a*, 2168*b* at the rear center of the skate boot 2100.

Figure 30:
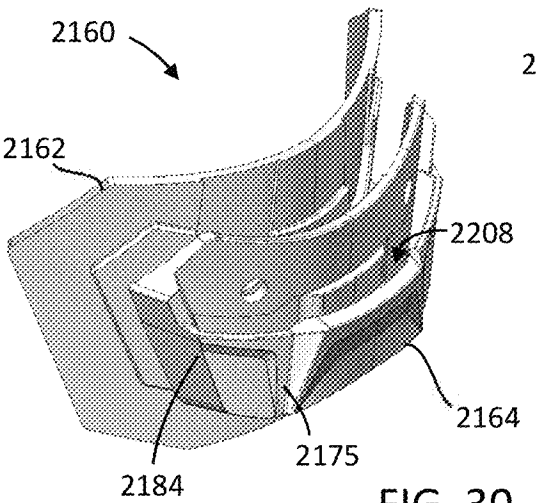
FIG. 30 is a rear perspective view of a mount portion of the skate boot of FIG. 23.

Referring to FIG. 30, in the example illustrated, the rear portion 2164 of the mount 2160 comprises a mounting slot 2208 for slidably receiving at least a bottom of the lower portion 2134 of the guard frame 2132. The slot 2208 is sized and shaped for nesting the bottom of the lower portion 2134 in close fit, with at least a portion of the bottom below the mount flex portion 2166. This can help with, for example, mounting and retention of the guard frame 2132 in the mount 2160 (e.g. by aligning fastening holes, supporting the guard frame during mounting, and reducing the need for a fastener below the flex portion 2166 for connecting the bottom of the lower portion to the mount 2160). This may also help with, for example, force transfer between the mount 2160 and the guard frame 2132.

Figure 32:
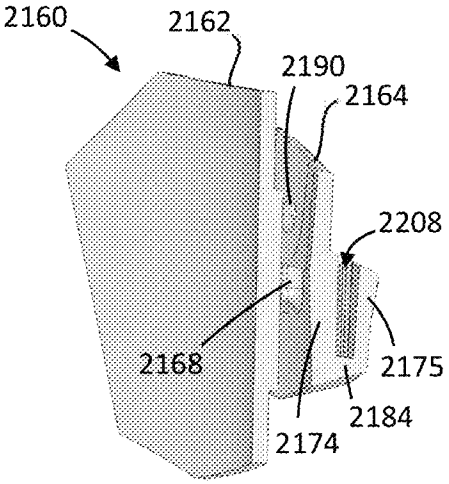
FIG. 32 is a cross-sectional view of the mount portion of FIG. 30, taken along line 32-32 of FIG. 31.

In the example illustrated, the slot 2208 has an open top to facilitate insertion of the lower portion 2134 of the guard frame 2132 into the slot 2208, and a closed bottom. Referring to FIG. 32, in the example illustrated, the slot 2208 is bounded by a pair of axially spaced apart rear panels 2174, 2175 of the rear portion 2164. One or more wall portions 2184 extend between and join the rear panels 2174, 2175. In the example illustrated, the wall portions 2184 bound the bottom and laterally opposed sides of the slot 2208. In other examples, the slot may have an open bottom (as shown with respect to the mount 4160 in FIG. 39), and/or may have one or both sides open (and the bottom closed, for example).

Figures 27, 28, 29:
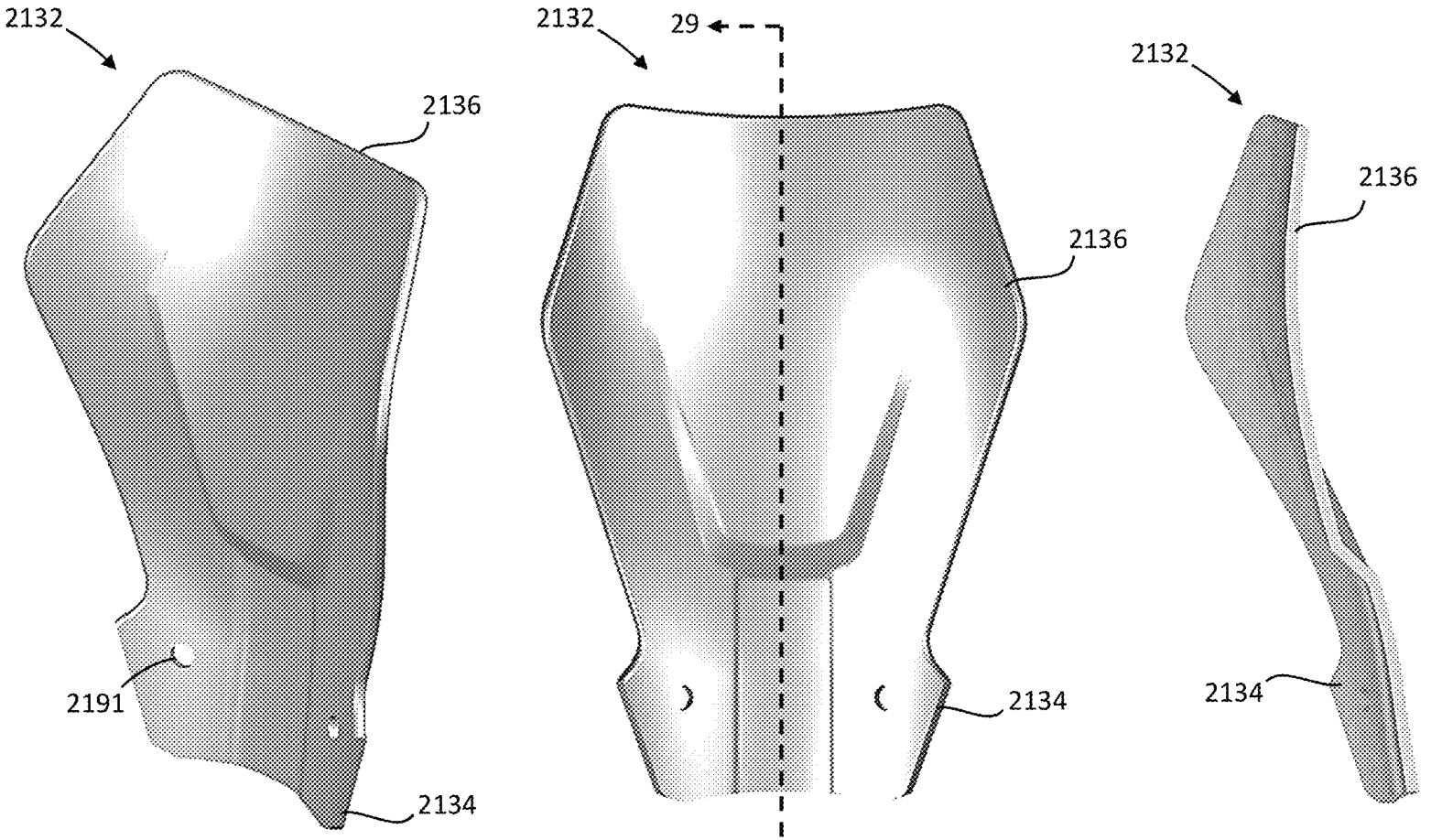
FIG. 27 is a front perspective view of a tendon guard frame structure of the skate boot of FIG. 23.
FIG. 28 is a front view of the tendon guard frame structure of FIG. 27.
FIG. 29 is a cross-sectional view of the tendon guard frame structure of FIG. 27, taken alone line 29-29 of FIG. 28.
Figure 31:
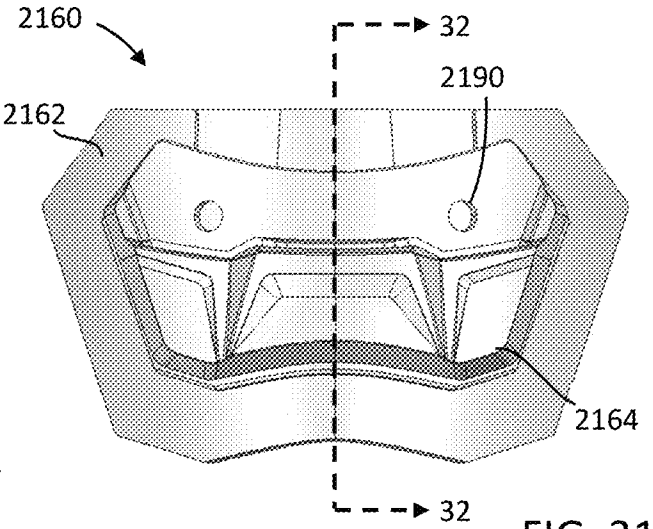
FIG. 31 is a rear view of the mount portion of FIG. 30.

Referring to FIG. 24, in the example illustrated, the guard frame 2132 is secured to the mount 2160 via one or more fasteners 2188 (e.g. rivets). Referring to FIG. 31, the rear portion 2164 of the mount 2160 can include one or more mount holes 2190 for receiving the fasteners 2188 to secure the guard frame 2132 to the mount 2160. In the example illustrated, the rear portion 2164 includes a pair of laterally spaced apart mount holes 2190 passing axially through the first rear panel 2174 at an elevation above the mount flex portion 2166 and the slot 2208 (see also FIG. 32). Referring to FIG. 27, in the example illustrated, the lower portion 2134 of the guard frame 2132 includes corresponding guard frame holes 2191. The guard frame holes 2191 are in alignment with the mounting holes 2190 when the guard frame 2132 is received in the slot 2208, and the fasteners 2188 extend through the mount and guard frame holes 2190, 2191 (at an elevation above the flex portion 2166, in the example illustrated) to secure the guard frame 2132 to the rear portion 2164 of the mount 2160 (see also FIGS. 25 to 26).

Figure 36:
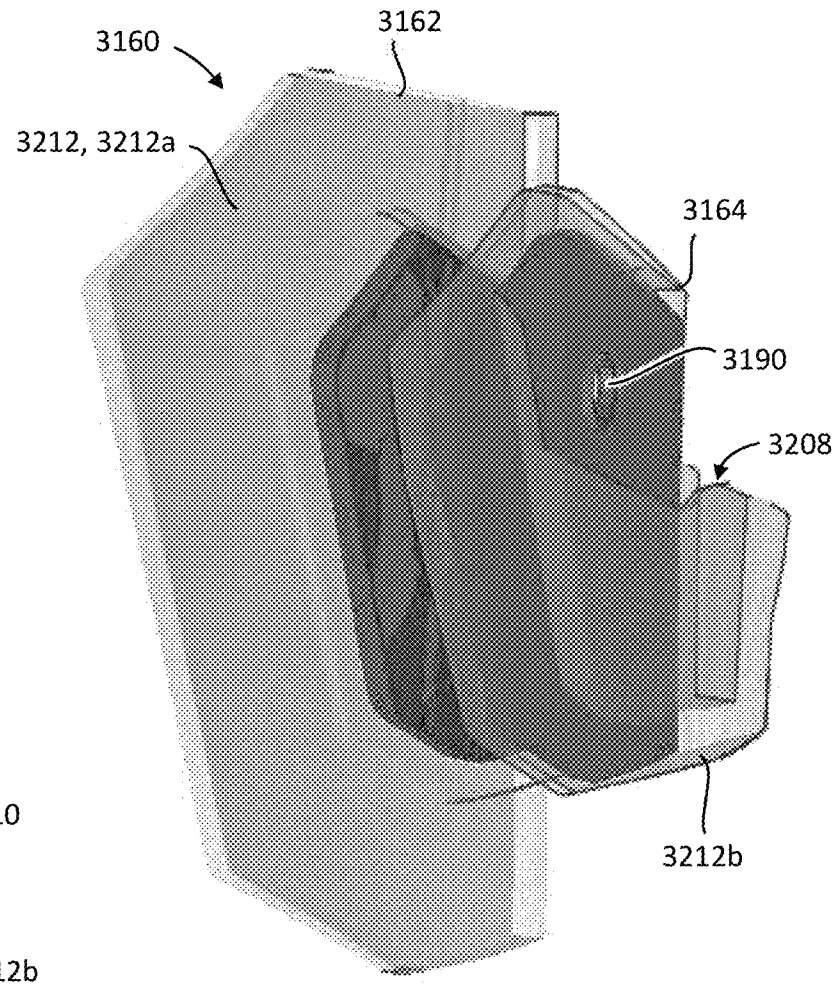
FIG. 36 is a side view of the mount portion of FIG. 34.
Figure 34:
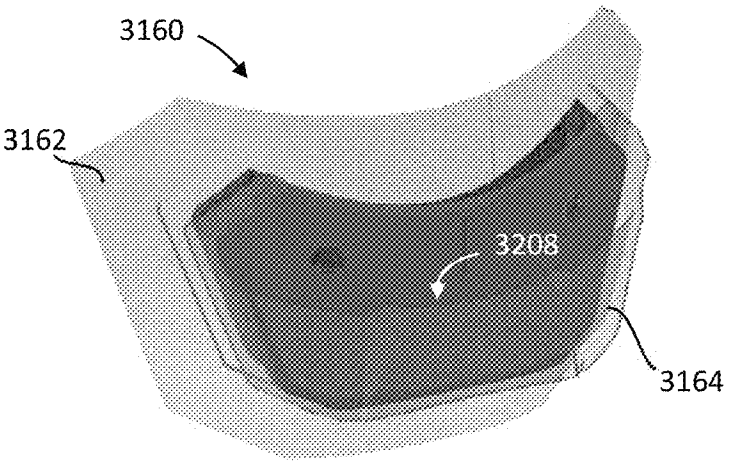
FIG. 34 is a rear perspective view of another example mount portion for a skate boot.
Figure 35:
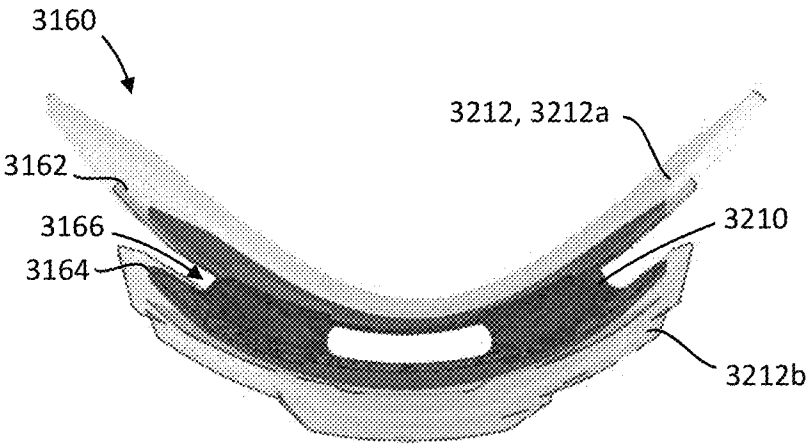
FIG. 35 is a top view of the mount portion of FIG. 34.

Referring to FIGS. 34 to 36, another example mount 3160 for a skate boot (e.g. like the boot 2100) is illustrated. The mount 3160 has similarities to the mount 2160 and like features are identified by like reference characters, incremented by 1000.

In the example illustrated, the mount 3160 includes a mount flex portion 3166 extending between and joining a mount front portion 3162 and a mount rear portion 3164. In the example illustrated, the mount 3160 includes a core 3210

(shown opaque in FIGS. 34 to 36) forming the flex portion 3166, and one or more outer layers 3212 (shown partially transparent in FIGS. 34 to 36) molded over at least a portion of the core 3210. In the example illustrated, the outer layers 3212 form at least a portion of the mount front portion 3162 and/or the mount rear portion 3164. In the example illustrated, the outer layers 3212 include a front outer layer 3212*a* molded over a front of the core 3210 and forming a front of the mount front portion 3162. In the example illustrated, the outer layers 3212 include a rear outer layer 3212*b* molded over a rear of the core 3210 and forming a rear of the mount rear portion 3164. In the example illustrated, the rear outer layer 3212*b* forms a slot 3208 for receiving a tendon guard frame (e.g. like the frame 2132), and a plurality of mount holes 3190 passing through an upper portion of the rear outer layer 3212*b* for receiving fasteners to secure the guard frame to the mount 3160. In the example illustrated, the flex portion 3166 is free of any over molded outer layers 3212.

In the example illustrated, the core 3210 is made of a core material, and the one or more outer layers 3212 are made of an outer layer material having material properties different from that of the core material. In some examples, the core material can be more flexible than the outer layer material to facilitate flexion at the flex portion 3166, and the outer layer material can be stiffer than the core material to facilitate securing the mount 3160 to the skate boot shell and/or the guard frame 3132 to the mount 3160.

Figure 37:
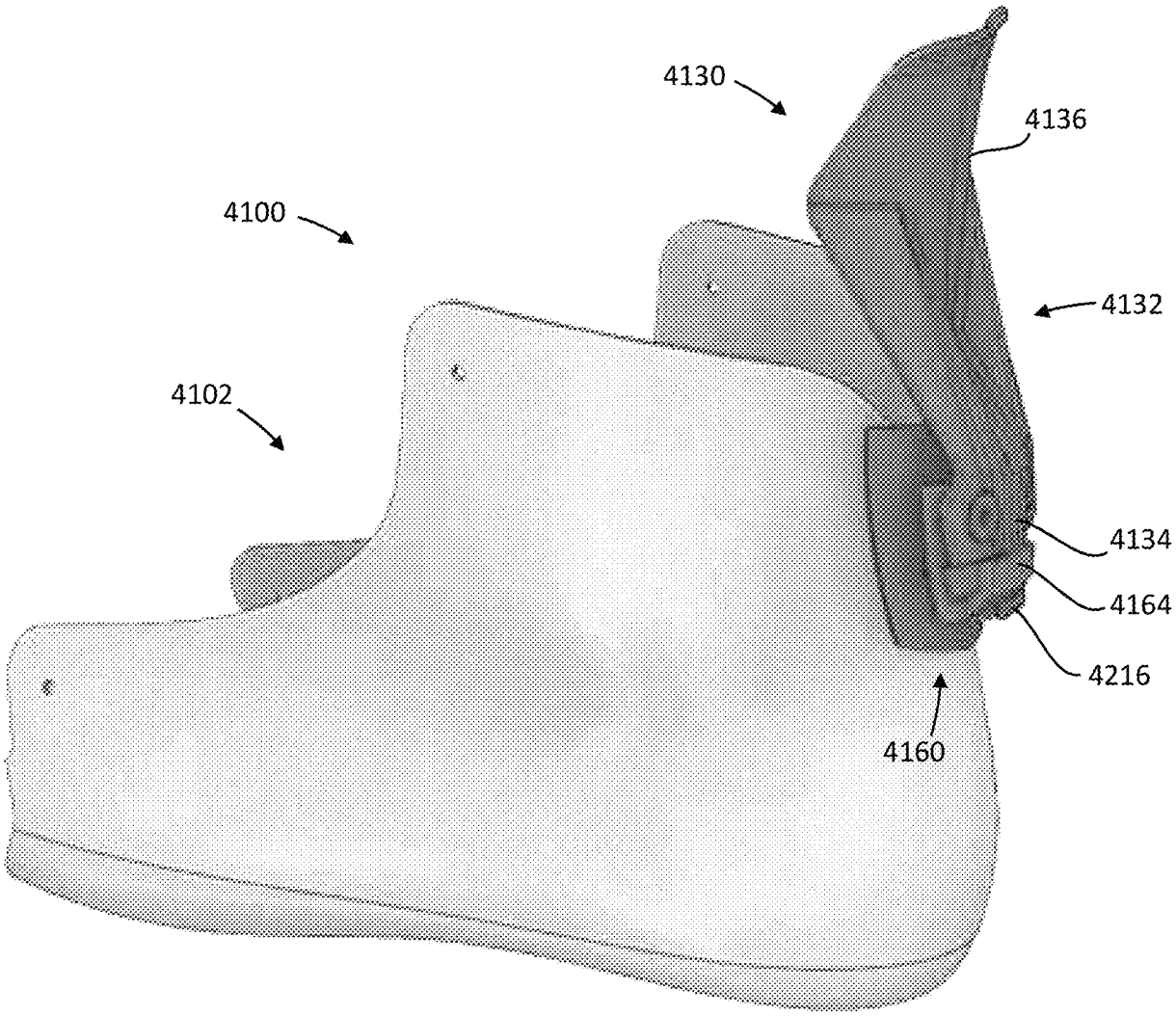
FIG. 37 is a rear perspective view of another example skate boot.

FIG. 37 shows another example skate boot 4100. The skate boot 4100 has similarities to the skate boot 2100, and like features are identified with like reference characters, incremented by 2000.

Figure 38:
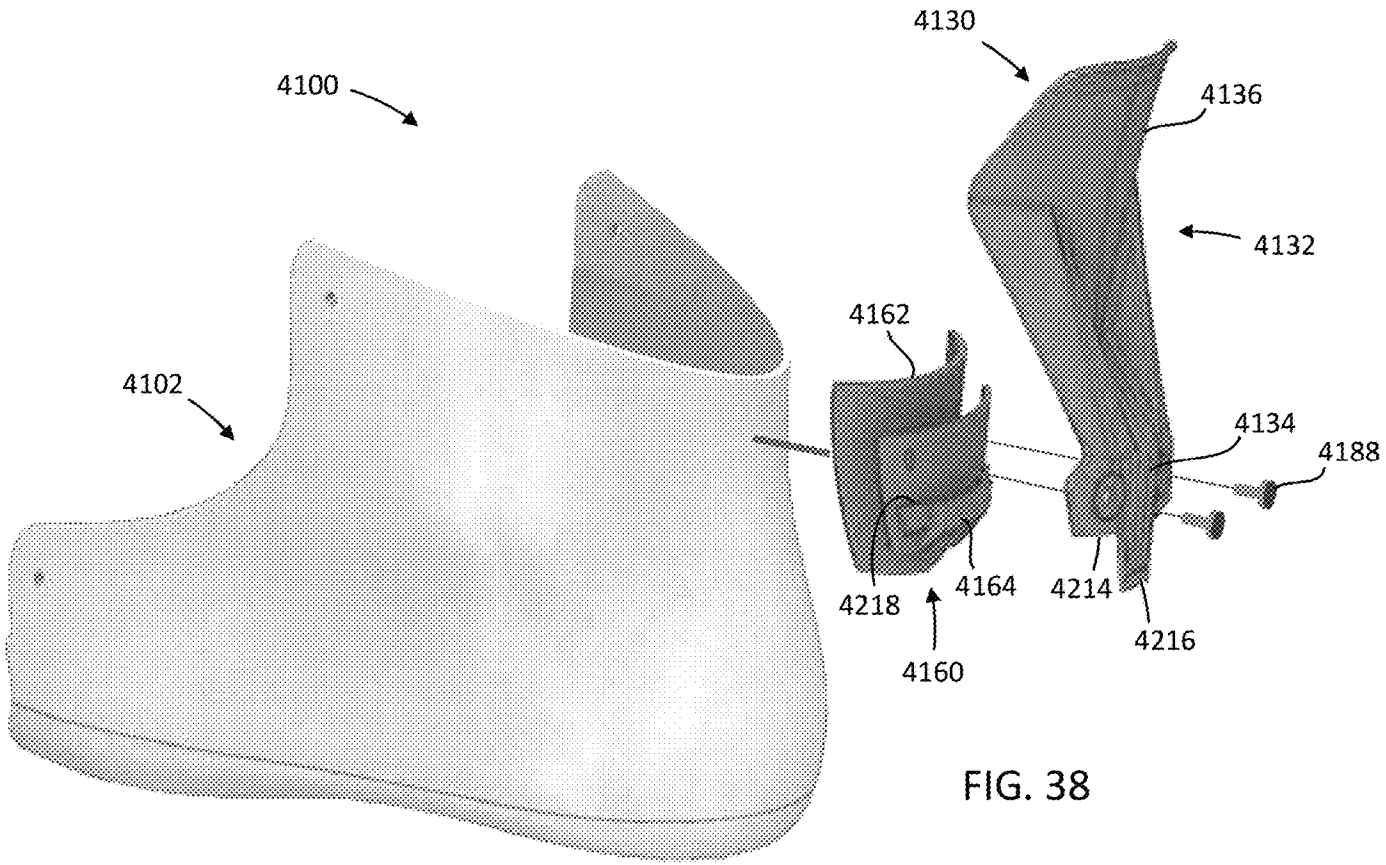
FIG. 38 is an exploded view of the skate boot of FIG. 37.

In the example illustrated, the skate boot 4100 includes a structural shell 4102 and a tendon guard 4130 attached to the shell 4102. The tendon guard 4130 includes a structural guard frame 4132 having a lower portion 4134 and an upper portion 4136 extending above the shell 4102. Referring to FIG. 38, in the example illustrated, the lower portion of the guard frame 4132 comprises one or more underside surfaces 4214, and a projection 4216 projecting downwardly relative to the underside surfaces 4214 at the bottom of the guard frame 4132.

Figure 39:
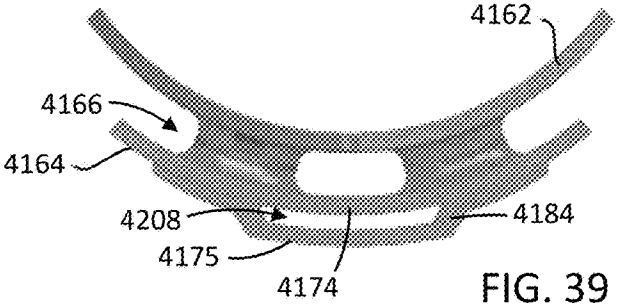
FIG. 39 is a top view of a mount portion of the skate boot of FIG. 37.
Figure 40:
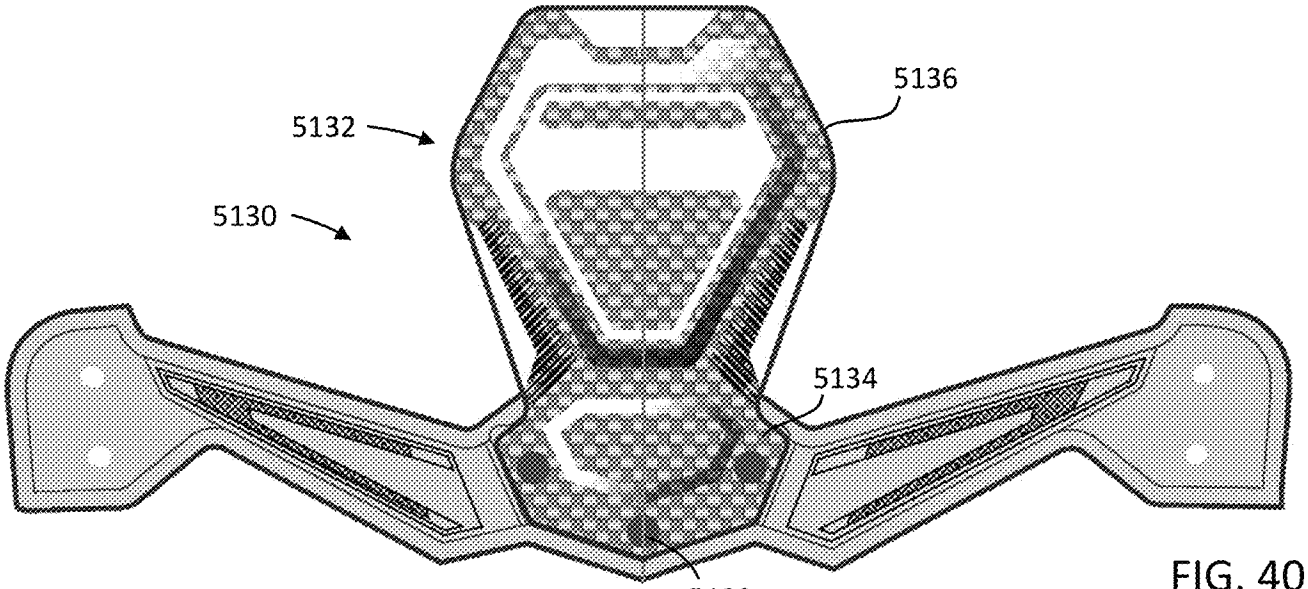
FIG. 40 is a rear view of another example tendon guard assembly for a skate boot.
Figure 41:
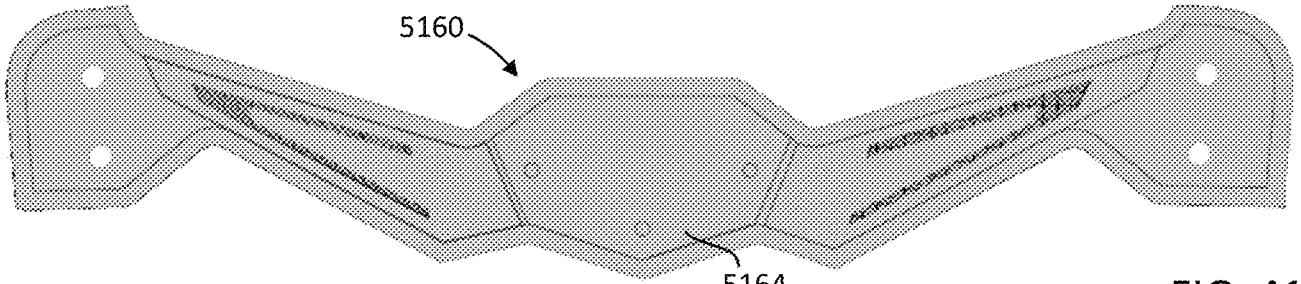
FIG. 41 is a rear view like that of FIG. 40, but with a tendon guard frame structure removed to show a mount portion of the tendon guard assembly.
Figure 42:
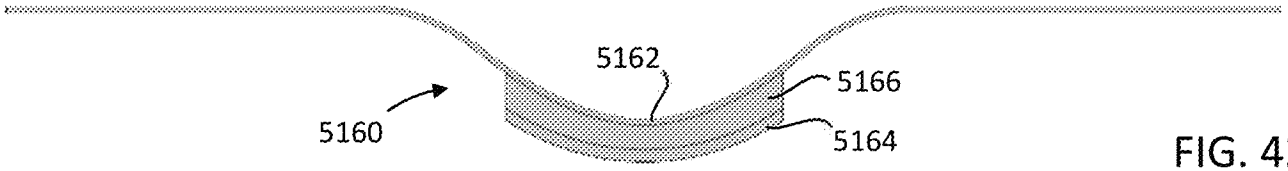
FIG. 42 is a top view of the tendon guard portions of FIG. 41.

In the example illustrated, the skate boot 4100 further includes a mount 4160 joining the guard frame 4132 to the shell 4102. Referring to FIG. 39, the mount 4160 includes a mount flex portion 4166 intermediate and joining mount front and rear portions 4162, 4164 of the mount 4160. In the example illustrated, the rear portion 4164 of the mount 4160 comprises a mounting slot 4208 for slidably receiving at least a bottom of the lower portion 4134 of the guard frame 4132. In the example illustrated, the slot 4208 is shaped for receiving the projection 4216 of the guard frame 4132 in close fit. In the example illustrated, the slot 4208 has an open top to facilitate insertion of the projection 4216 into the slot 4208, and an open bottom through which a lower end of the projection 4216 projects when received in the slot 4208 (see e.g., FIG. 37). In the example illustrated, the slot 4208 is bounded by a pair of axially spaced apart rear panels 4174, 4175 of the rear portion 4164. A plurality of wall portions 4184 extend between the first and second rear panels 4174, 4175 and bound laterally opposed sides of the slot 4208. Referring to FIG. 38, when the projection 4216 is received in the slot 4208 (best shown in FIG. 39), the underside surfaces 4214 of the guard frame 4132 are supportable atop corresponding support surfaces 4218 fixed to the rear portion 4164 of the mount 4160. In the example illustrated, the support surfaces 4218 comprise upper surfaces of the wall portions 4184.

Still referring to FIG. 38, in the example illustrated, the guard frame 4132 is secured to the mount 4160 via one or more fasteners 4188 (e.g. rivets) passing through the lower portion 4134 of the guard frame 4132 (above the underside surfaces 4214, in the example illustrated) and the rear portion 4164 of the mount 4160 (at an elevation above the flex portion 4166, in the example illustrated).

Figure 44:
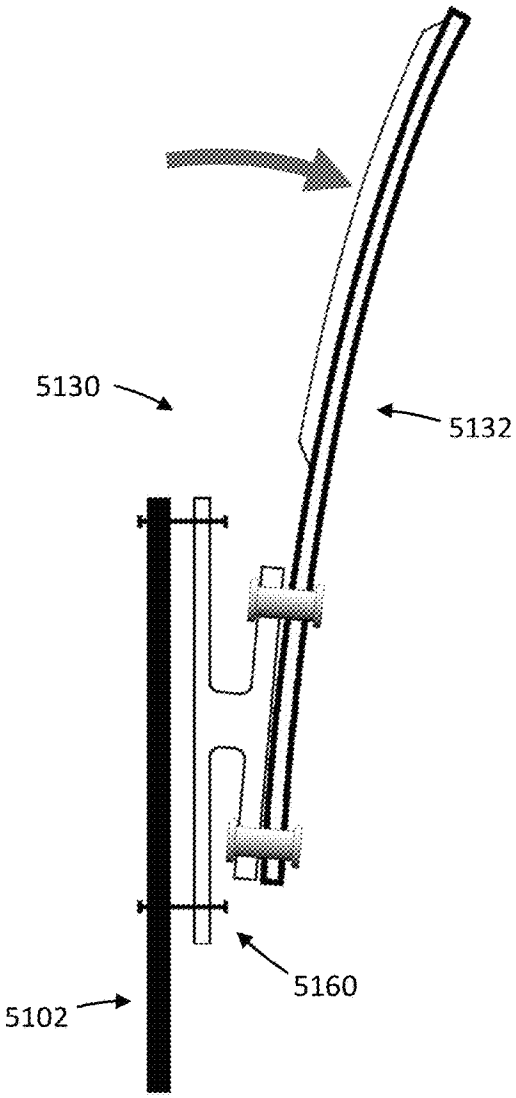
FIG. 44 is a schematic side view like that of FIG. 43, but showing the tendon guard portions in a rearward state.
Figure 43:
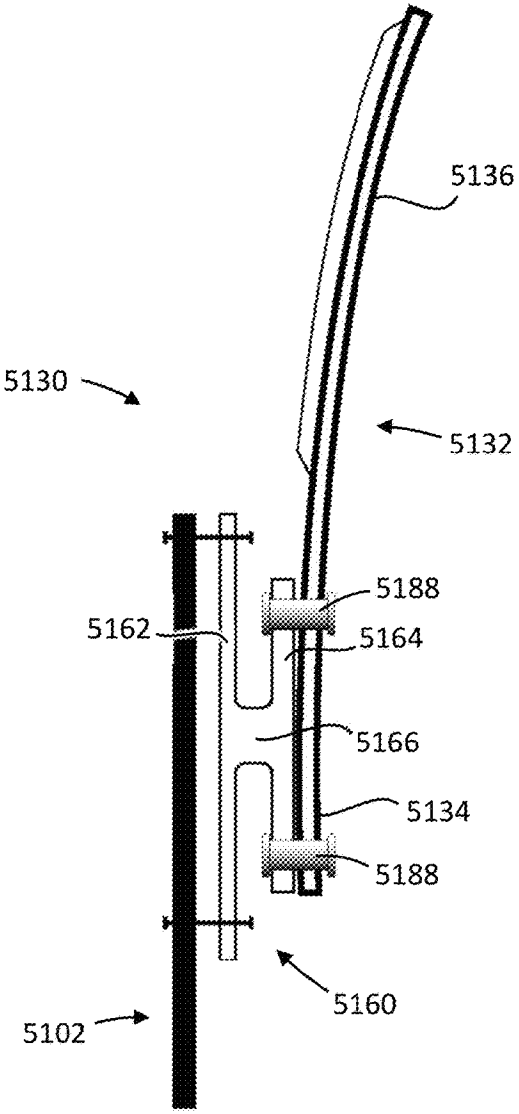
FIG. 43 is a schematic side view of portions of the tendon guard assembly of FIG. 40 mounted to a skate boot shell structure, and showing a tendon guard portions of the skate boot in a resting state.

Another example tendon guard 5130 fora skate boot (e.g. like the boot 1100) is shown in FIGS. 40 to 44. Referring to FIGS. 43 to 44, the tendon guard 5130 is attachable to a shell 5102 of the skate boot and includes a structural guard frame 5132 having a lower portion 5134 and an upper portion 5136 extending above the shell 5102. In the example illustrated, the tendon guard 5130 further includes a mount 5160 joining the guard frame 5132 to the shell 5102. The mount 5160 includes a mount flex portion 5166 intermediate and joining front and rear portions 5162, 5164 of the mount 5160. In the example illustrated, the guard frame 5132 is secured to the mount 5160 via a plurality of fasteners 5188 (e.g. rivets) extending through the lower portion 5134 of the guard frame 5132 and the rear portion 5164 of the mount 5160. In the example illustrated, at least one fastener 5188 passes through the rear portion 5164 at an elevation above the flex portion 5166 and at least one fastener 5188 passes through the rear portion 5164 at an elevation below the flex portion 5166 for securing the guard frame 5132 to the mount 5160.

The invention claimed is:

1. A skate boot comprising:

a) a structural shell configured to cover at least a rear and sides of a foot of a wearer; and b) a tendon guard attached to the shell and configured to protect an Achilles tendon of the wearer, the tendon guard including:

i) a lower portion attached to the shell, ii) an upper portion extending above a rear upper edge of the shell, the upper portion configured to protect at least a portion the Achilles tendon above the shell, and iii) a flex portion located below the rear upper edge of the shell, the flex portion having sufficient flexibility to permit rearward movement of the upper portion from a resting position toward a rearward position in response to application of a rearward force on the upper portion by a lower leg of the wearer during plantarflexion, and the flex portion having sufficient resiliency to urge the upper portion back toward the resting position when the rearward force is relieved, wherein the structural shell has a medial portion for covering a medial side of the foot and a lateral portion laterally opposite the medial portion for covering a lateral side of the foot, and the rear upper edge extends across a rearmost portion of the shell between the medial portion and the lateral portion of the shell, and wherein the flex portion is at an elevation below a lowermost section of the rear upper edge.

2. The skate boot of claim 1, wherein the tendon guard includes a structural guard frame comprising the upper, lower, and flex portions.

3. The skate boot of claim 1, wherein the tendon guard includes a structural guard frame comprising the upper and lower portions, and a mount joining the guard frame to the shell and comprising the flex portion.

4. A skate boot comprising:

a) a structural shell configured to cover at least a rear and sides of a foot of a wearer; and b) a tendon guard attached to the shell and configured to protect an Achilles tendon of the wearer, the tendon guard including a flex portion located below a rear upper edge of the shell, the flex portion having sufficient flexibility to permit rearward movement of an upper portion of the tendon guard in response to application of a rearward force on the upper portion by a lower leg of the wearer during plantarflexion, and the flex portion having sufficient resiliency to urge the upper portion back toward a resting position when the rearward force is relieved, wherein the structural shell has a medial portion for covering a medial side of the foot and a lateral portion laterally opposite the medial portion for covering a lateral side of the foot, and the rear upper edge extends across a rearmost portion of the shell between the medial portion and the lateral portion of the shell, and wherein the flex portion is at an elevation below a lowermost section of the rear upper edge.

5. The skate boot of claim 4, wherein the tendon guard includes a guard frame configured to protect at least a portion of the Achilles tendon above the shell, and a mount joining the guard frame to the shell and comprising the flex portion, the flex portion comprising at least one beam member extending substantially horizontally between a mount front portion attached to the shell and a mount rear portion attached to the guard frame.

6. The skate boot of claim 4, wherein the shell is made of a first material and the tendon guard includes a guard frame made of a second material stiffer than the first material, the guard frame including a lower portion attached to the shell, an upper portion extending above the rear upper edge of the shell, and the flex portion vertically intermediate the upper and lower portions, and wherein the upper portion has a first geometry configured to inhibit flexure of the upper portion during application of the rearward force and the flex portion has a second geometry having a reduced flexural rigidity relative to the first geometry to permit rearward movement of the upper portion via flexion of the flex portion during application of the rearward force.

7. A skate boot comprising:

a) a structural shell configured to cover at least a rear and sides of a foot of a wearer, the shell made of a first material; and b) a tendon guard attached to the shell and configured to protect an Achilles tendon of the wearer, the tendon guard including a structural guard frame made of a second material stiffer than the first material, the frame including:

i) a lower portion attached to the shell, ii) an upper portion extending above a rear upper edge of the shell, the upper portion configured to protect at least a portion the Achilles tendon above the shell, and iii) a flex portion vertically intermediate the upper and lower portions, the flex portion having sufficient flexibility to permit rearward movement of the upper portion from a resting position toward a rearward position in response to application of a rearward force on the upper portion by a lower leg of the wearer during plantarflexion, and the flex portion having sufficient resiliency to urge the upper portion back toward the resting position when the rearward force is relieved, wherein the structural shell has a medial portion for covering a medial side of the foot, a lateral portion laterally opposite the medial portion for covering a lateral side of the foot, and a rear portion extending between the medial and lateral portion for covering the rear of the foot and to which the lower portion of the tendon guard is attached, each of the medial, lateral, and rear portions formed of the first material and being generally rigid to support and protect the sides and the rear of the foot.

8. The skate boot of claim 7, wherein the upper portion has a first geometry and the flex portion has a second geometry, the second geometry having a reduced flexural rigidity relative to the first geometry.

9. The skate boot of claim 8, wherein the first geometry is configured to inhibit flexure of the upper portion during application of the rearward force, and the reduced flexural rigidity of the second geometry permits rearward movement of the upper portion via flexion of the flex portion during application of the rearward force.

10. The skate boot of claim 7, wherein the structural frame has laterally opposed side edges, and the upper portion includes a curved region extending between the side edges and configured to curve about a rear of the lower leg and inhibit flexure of the upper portion, and the flex portion has a generally planar region extending between the side edges and configured to facilitate flexure of the flex portion.

11. The skate boot of claim 7, wherein the flex portion is disposed below the rear upper edge of the shell.

12. The skate boot of claim 7, wherein the upper portion has a first lateral extent and the flex portion has a second lateral extent that is less than the first lateral extent.

13. The skate boot of claim 7, wherein the guard frame is of integral, unitary, one-piece construction.

14. The skate boot of claim 7, wherein the first material has a first flexural modulus and the second material has a second flexural modulus greater than the first flexural modulus.

15. The skate boot of claim 7, wherein the second material comprises a fiber reinforced polymer including a matrix material and reinforcing fibers in the matrix material.

16. The skate boot of claim 15, wherein the reinforcing fibers comprise carbon fibers.

17. The skate boot of claim 16, wherein the matrix material comprises epoxy.

* * * * *